US011376855B2

(12) United States Patent
Nakada et al.

(10) Patent No.: US 11,376,855 B2
(45) Date of Patent: Jul. 5, 2022

(54) LIQUID ABSORBER AND METHOD FOR PRODUCING SAME, AND LIQUID EJECTION APPARATUS

(71) Applicant: SEIKO EPSON CORPORATION, Tokyo (JP)

(72) Inventors: Shogo Nakada, Nagano (JP); Naotaka Higuchi, Fujimi-machi (JP); Yoichi Miyasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/941,648

(22) Filed: Jul. 29, 2020

(65) Prior Publication Data

US 2021/0031527 A1 Feb. 4, 2021

(30) Foreign Application Priority Data

Jul. 31, 2019 (JP) ..... JP2019-141040

(51) Int. Cl.
*B41J 2/17* (2006.01)

(52) U.S. Cl.
CPC ..... *B41J 2/1721* (2013.01); *B41J 2002/1728* (2013.01)

(58) Field of Classification Search
CPC ..... B41J 2/1721; B41J 2002/1728
See application file for complete search history.

(56) References Cited

U.S. PATENT DOCUMENTS

| | | | | |
|---|---|---|---|---|
| 9,327,503 | B2 | 5/2016 | Higuchi | |
| 2014/0292913 | A1 | 10/2014 | Higuchi | |
| 2019/0299607 | A1* | 10/2019 | Miyasaka | B41J 2/16523 |

FOREIGN PATENT DOCUMENTS

| | | | | |
|---|---|---|---|---|
| CN | 103895355 A | * | 7/2014 | B41J 2/1721 |
| JP | 2012192664 A | * | 10/2012 | B41J 2/1721 |
| JP | 2014-188802 A | | 10/2014 | |
| WO | WO-2019187444 A1 | * | 10/2019 | B41J 2/16523 |

* cited by examiner

*Primary Examiner* — Justin Seo
(74) *Attorney, Agent, or Firm* — Global IP Counselors, LLP

(57) ABSTRACT

A liquid absorber includes a case, a first liquid absorption member stored in the case, and a second liquid absorption member stored in the case. The case has an opening. The first liquid absorption member absorbs a portion of a liquid. The second liquid absorption member absorbs a portion of the liquid. The second liquid absorption member is disposed adjacent to the first liquid absorption member and is closer to the opening than is the first liquid absorption member. The first liquid absorption member and the second liquid absorption member include fiber substrates and a liquid-absorbent resin, the liquid-absorbent resin being liquid-absorbent resin particles.

7 Claims, 23 Drawing Sheets

LIQUID ABSORBER AND METHOD FOR PRODUCING SAME, AND LIQUID EJECTION APPARATUS

The present application is based on, and claims priority from JP Application Serial Number 2019-141040, filed Jul. 31, 2019, the disclosure of which is hereby incorporated by reference herein in its entirety.

BACKGROUND

1. Technical Field

The present disclosure relates to a liquid absorber and a method for producing the same and also relates to a liquid ejection apparatus.

2. Related Art

In ink jet printers, waste ink is typically generated during a head cleaning operation, which is performed to prevent a reduction in printing quality due to nozzle clogging caused by the drying of ink, and during an ink filling operation after a replacement of an ink cartridge. To absorb waste ink, a liquid absorber including a liquid absorption member is used.

For example, JP-A-2014-188802 describes a liquid absorption member that absorbs liquid. The liquid absorption member is formed primarily of a fiber and includes a fused resin.

Unfortunately, in the liquid absorption member of JP-A-2014-188802, the individual fibers are fused to one another with a fused resin, and, therefore, the liquid absorption member needs to be processed to fit the shape of the case in which the liquid absorption member is to be stored. Thus, the liquid absorption member has low versatility and incurs high processing costs.

Correspondingly, the development of liquid absorption members that can conform to the shape of any desired case and can be provided at reduced processing costs is being advanced. Examples of such liquid absorption members include an assembly of crushed pieces.

However, with a liquid absorption member that conforms to the shape of any desired case, it is difficult to ensure good absorption characteristics, because the crushed pieces can become unevenly distributed during transfer, for example.

SUMMARY

According to an aspect of the present disclosure, a liquid absorber includes a case, a first liquid absorption member stored in the case, and a second liquid absorption member stored in the case. The case has an opening. The first liquid absorption member absorbs a portion of a liquid. The second liquid absorption member absorbs a portion of the liquid. The second liquid absorption member is disposed adjacent to the first liquid absorption member and is closer to the opening than is the first liquid absorption member. The first liquid absorption member and the second liquid absorption member include fiber substrates and a liquid-absorbent resin, the liquid-absorbent resin being liquid-absorbent resin particles. The first liquid absorption member includes a first bonded portion in which at least some of the fiber substrates are bonded to one another. The first bonded portion is disposed in a surface of the first liquid absorption member, the surface being closer to the second liquid absorption member than is another surface of the first liquid absorption member. The second liquid absorption member includes a second bonded portion in which at least some of the fiber substrates are bonded to one another. The second bonded portion is disposed in a surface of the second liquid absorption member, the surface being closer to the opening than is another surface of the second liquid absorption member.

According to another aspect, the liquid absorber may be as follows. In the first bonded portion, the at least some of the fiber substrates may be bonded to one another with at least one of a bonding force of a water-soluble adhesive and an adhesive force of the liquid-absorbent resin. In the second bonded portion, the at least some of the fiber substrates may be bonded to one another with the at least one of a bonding force of a water-soluble adhesive and an adhesive force of the liquid-absorbent resin.

According to another aspect, the liquid absorber may be as follows. The at least some of the fiber substrates in the first liquid absorption member may be bonded to a bottom portion of the case and a sidewall portion of the case with at least one of a bonding force of a water-soluble adhesive and an adhesive force of the liquid-absorbent resin. The at least some of the fiber substrates in the second liquid absorption member may be bonded to a sidewall portion of the case with the at least one of a bonding force of a water-soluble adhesive and an adhesive force of the liquid-absorbent resin.

According to another aspect, the liquid absorber may be as follows. A rib may be disposed on an inner surface of the case, the rib protruding from the inner surface. The at least some of the fiber substrates in the first liquid absorption member and the at least some of the fiber substrates in the second liquid absorption member may be bonded to the rib with at least one of a bonding force of a water-soluble adhesive and an adhesive force of the liquid-absorbent resin.

According to another aspect, the liquid absorber may be as follows. The first liquid absorption member and the second liquid absorption member may be formed of small pieces. The small pieces may include the fiber substrates and the liquid-absorbent resin, the liquid-absorbent resin being supported on the fiber substrates. At least some of the small pieces may be bonded to one another with at least one of a bonding force of a water-soluble adhesive and an adhesive force of the liquid-absorbent resin.

According to another aspect, the liquid absorber may be as follows. The at least some of the small pieces may be bonded to at least one of the case and the rib with the at least one of a bonding force of a water-soluble adhesive and an adhesive force of the liquid-absorbent resin.

According to another aspect, the liquid absorber may be as follows. The liquid-absorbent resin may be held between a pair of the fiber substrates.

According to an aspect of the present disclosure, a liquid absorber includes a case and a liquid absorption member stored in the case. The liquid absorption member is a member that absorbs at least a portion of a liquid. The liquid absorption member includes fiber substrates and a liquid-absorbent resin, the liquid-absorbent resin being liquid-absorbent resin particles. The liquid absorption member includes a first portion and a second portion. In the first portion, at least some of the fiber substrates are bonded to one another. In the second portion, at least some of the fiber substrates are unbonded to one another.

According to another aspect, the liquid absorber may be as follows. The liquid absorption member may include a plurality of the first portions and a plurality of the second portions, and the first portions and the second portions may be alternately stacked.

According to an aspect of the present disclosure, a method for producing a liquid absorber is as follows. A first liquid absorption member is stored in a case having an opening, the first liquid absorption member being a member that absorbs a portion of a liquid, the first liquid absorption member including fiber substrates and a liquid-absorbent resin. One of water and a water-soluble adhesive solution is applied to a surface of the first liquid absorption member from a side of the opening. A second liquid absorption member is stored in the case, the second liquid absorption member being positioned closer to the opening than is the first liquid absorption member, the second liquid absorption member being a member that absorbs a portion of the liquid, the second liquid absorption member including fiber substrates and a liquid-absorbent resin. One of water and a water-soluble adhesive solution is applied to a surface of the second liquid absorption member from the side of the opening.

According to an aspect of the present disclosure, a method for producing a liquid absorber is as follows. One of water and a water-soluble adhesive solution is applied to a first liquid absorption member, the first liquid absorption member being a member that absorbs at least a portion of a liquid, the first liquid absorption member including fiber substrates and a liquid-absorbent resin. The first liquid absorption member is stored in a case, the first liquid absorption member including the one of water and a water-soluble adhesive solution applied thereto.

According to another aspect, the method for producing a liquid absorber may be as follows. After the first liquid absorption member is stored in the case, one of water and a water-soluble adhesive solution may be applied to a second liquid absorption member, the second liquid absorption member being a member that absorbs a portion of the liquid, the second liquid absorption member including fiber substrates and a liquid-absorbent resin. The second liquid absorption member may be stored in the case, the second liquid absorption member including the one of water and a water-soluble adhesive solution applied thereto.

According to another aspect, the method for producing a liquid absorber may be as follows. After the first liquid absorption member is stored in the case, a second liquid absorption member may be stored in the case, the second liquid absorption member being a member that absorbs a portion of the liquid, the second liquid absorption member including fiber substrates and a liquid-absorbent resin. One of water and a water-soluble adhesive solution may be applied to a surface of the second liquid absorption member, the second liquid absorption member being in the case.

According to another aspect, the method for producing a liquid absorber may be as follows. Before the first liquid absorption member is stored in the case, one of water and a water-soluble adhesive solution may be applied to an inner surface of the case.

According to an aspect of the present disclosure, a liquid ejection apparatus includes a liquid ejection head and the liquid absorber according to any of the aspects described above. The liquid absorber absorbs the liquid. The liquid is ejected from the liquid ejection head.

DESCRIPTION OF EXEMPLARY EMBODIMENTS

Preferred embodiments of the present disclosure will now be described in detail with reference to the drawings. Note that the embodiments described below are not intended to unduly limit the content of the present disclosure described in the claims. Furthermore, not all of the configurations described below may be essential configuration requirements of the present disclosure.

1. First Embodiment

1. 1. Liquid Absorber

Figure 1:
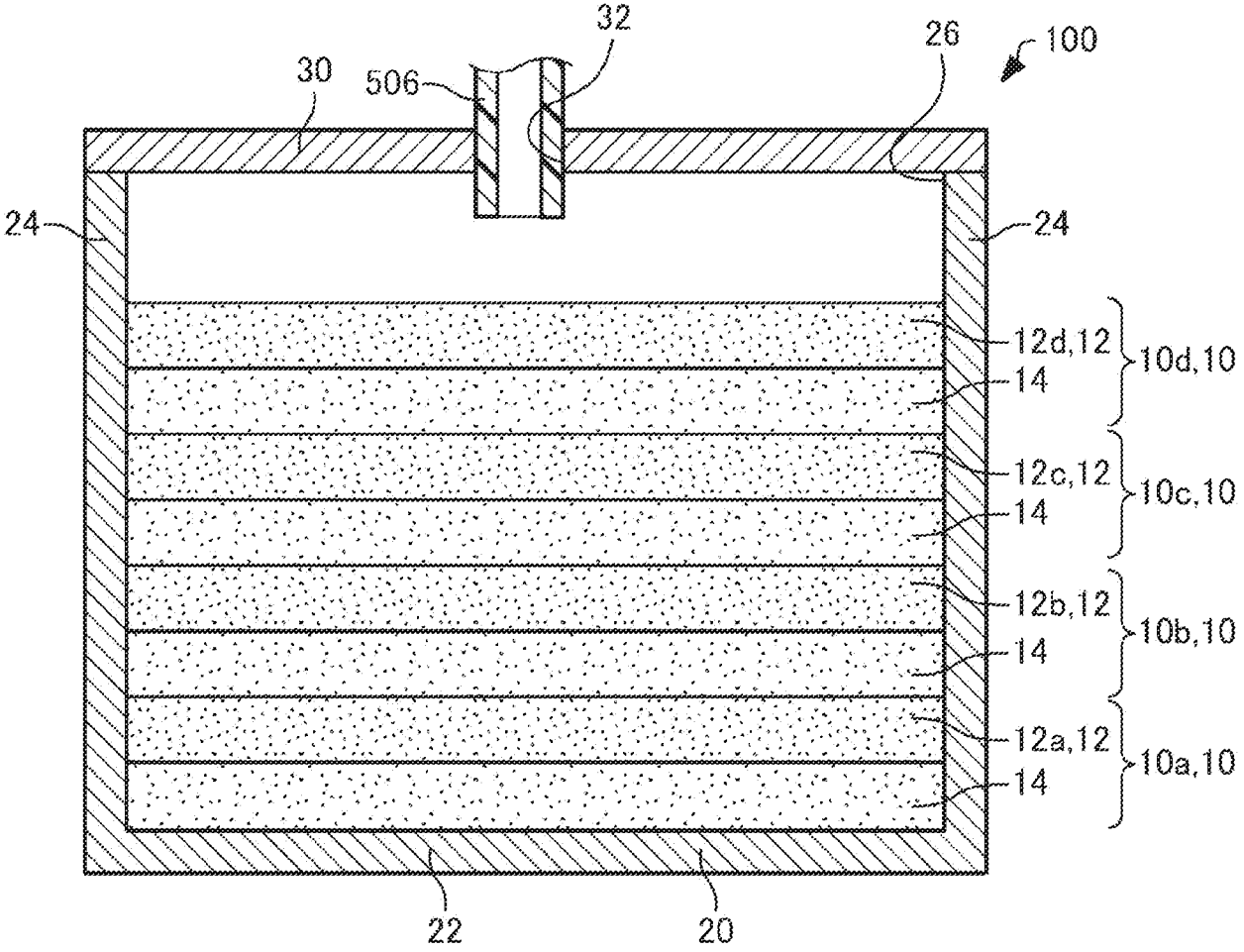
FIG. 1 is a schematic diagram of a liquid absorber according to a first embodiment.
Figure 2:
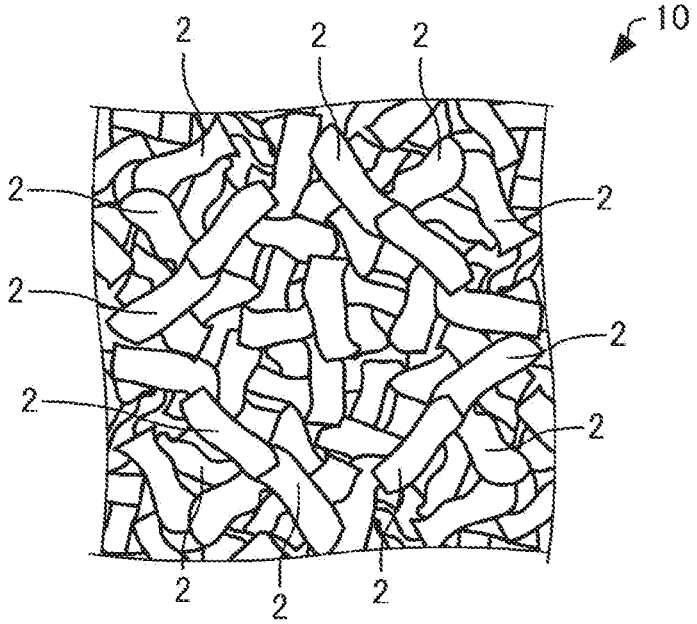
FIG. 2 is a schematic diagram of the liquid absorber according to the first embodiment.

First, a liquid absorber according to a first embodiment will be described with reference to the drawings. FIG. 1 is a schematic diagram of a liquid absorber 100, according to the first embodiment. FIG. 2 is a schematic diagram of the liquid absorber 100 according to the first embodiment. FIG. 2 is an enlarged view of a portion of a liquid absorption member 10, which is illustrated in FIG. 1.

As illustrated in FIG. 1, the liquid absorber 100 includes, for example, the liquid absorption member 10, a case 20, and a cover member 30. In the following description, each of the elements will be described.

1. 1. 1. Liquid Absorption Member

The liquid absorption member 10 absorbs liquid. Specifically, the liquid absorption member 10 absorbs inks, such as an aqueous ink in which a colorant is dissolved in an aqueous solvent, a solvent-based ink in which a binder is dissolved in a solvent, a UV (ultraviolet) curable ink in which a binder is dissolved in a liquid monomer and which is cured by UV irradiation, and a latex ink in which a binder is dispersed in a dispersion medium. The following description is made assuming that the liquid absorbed by the liquid absorption member 10 is ink.

1. 1. 1. 1. Small Pieces

Figure 3:
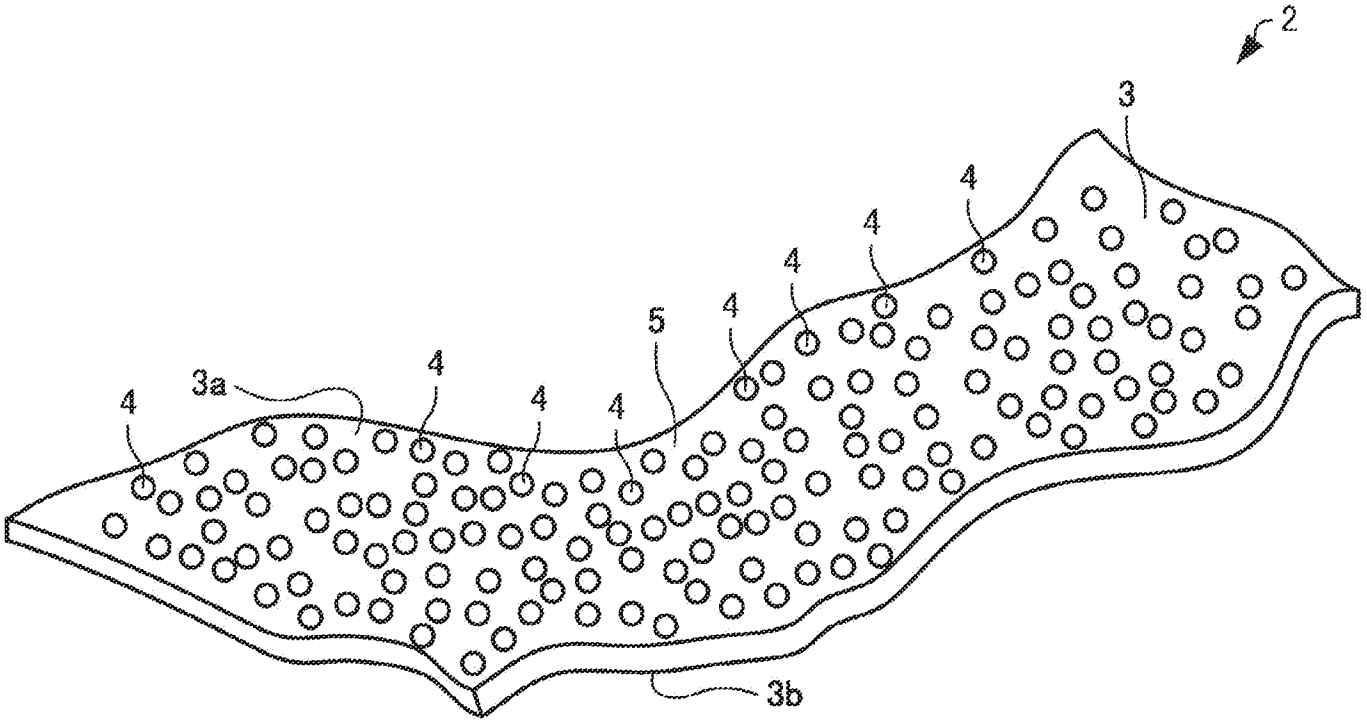
FIG. 3 is a schematic perspective view of a small piece included in the liquid absorber, according to the first embodiment.
Figure 4:
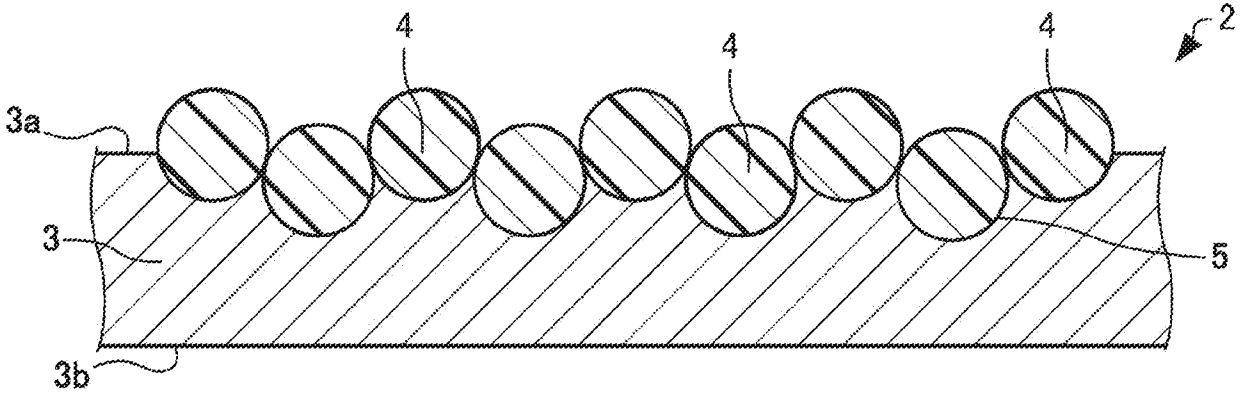
FIG. 4 is a schematic cross-sectional view of a small piece included in the liquid absorber, according to the first embodiment.

As illustrated in FIG. 2, the liquid absorption member 10 is formed of an assembly of small pieces 2, for example. FIG. 3 is a schematic perspective view of a small piece 2. FIG. 4 is a schematic cross-sectional view of a small piece 2. Note that, in FIG. 1, the liquid absorption member 10 is illustrated in a simplified manner for convenience.

As illustrated in FIG. 2, the liquid absorption member 10 is formed of small pieces 2, for example. As illustrated in FIG. 3 and FIG. 4, the small pieces 2 each include, for example, a fiber substrate 3 and a liquid-absorbent resin 4, which is supported on the fiber substrate 3.

It is preferable that the small pieces 2 be strip-shaped pieces having flexibility. With this configuration, the small pieces 2 can be easily deformed. Hence, when the liquid absorption member 10 is stored in the case 20, the liquid absorption member 10 is deformed regardless of the shape of the case 20 and, therefore, can be stored therein without difficulty.

A full length of the small pieces 2, that is, a length in a longitudinal direction of the small pieces 2, is preferably 0.5 mm or greater and 200 mm or less, more preferably 1 mm or greater and 100 mm or less, and even more preferably 2 mm or greater and 30 mm or less.

A width of the small pieces 2, that is, a length in a transverse direction of the small pieces 2, is preferably 0.1 mm or greater and 100 mm or less, more preferably 0.3 mm or greater and 50 mm or less, and even more preferably 1 mm or greater and 10 mm or less.

An aspect ratio between the full length of the small pieces 2 and the width thereof is preferably 1 or greater and 200 or less and more preferably 1 or greater and 30 or less. A thickness of the small pieces 2 is preferably 0.05 mm or greater and 2 mm or less and more preferably 0.1 mm or greater and 1 mm or less.

When the above-mentioned ranges are satisfied, the liquid-absorbent resin 4 can be suitably supported, ink can be suitably held in the fiber, and the ink can be suitably delivered to the liquid-absorbent resin 4; hence, the liquid absorption member 10 has excellent absorption characteristics with respect to ink. In addition, the liquid absorption member 10 can be easily deformed and, therefore, has improved conformability to the shape of the case 20.

For example, the small pieces 2 are stored in the case 20 randomly, without regularity, in a manner such that the longitudinal directions of the small pieces 2 do not extend parallel to one another but extend crosswise to one another. Thus, gaps can be easily formed between the small pieces 2. As a result, ink can flow through the gaps, and, when the gaps are very small, ink can wet and spread under capillary action. Accordingly, ink flowability is ensured. Hence, in the case 20, ink flowing downwardly is prevented from being blocked along the way, and as a result, the ink can penetrate to a bottom portion 22 of the case 20.

Since the small pieces 2 are stored randomly, the opportunity for the liquid absorption member 10 as a whole to come into contact with ink is increased, and, hence, the liquid absorption member 10 has excellent absorption characteristics with respect to ink. Furthermore, in the process of storing the liquid absorption member 10 into the case 20, the small pieces 2 can be thrown into the case 20 in a random manner, and, therefore, the operation can be carried out readily and quickly.

A bulk density of the liquid absorption member 10 is preferably 0.01 $g/cm^3$ or greater and 0.50 $g/cm^3$ or less, more preferably 0.03 $g/cm^3$ or greater and 0.30 $g/cm^3$ or less, and even more preferably 0.05 $g/cm^3$ or greater and 0.20 $g/cm^3$ or less. With such a bulk density, an ink retention and an ink penetration are both achieved.

1. 1. 1. 2. Fiber Substrate

The fiber substrate 3 has a sheet shape. The fiber substrate 3 is formed of individual fibers.

Examples of the fiber that is included in the fiber substrate 3 include synthetic resin fibers, such as polyester fibers and polyamide fibers, and natural resin fibers, such as cellulose fibers, keratinous fibers, and fibroin fibers.

It is preferable that the fiber included in the fiber substrate 3 be a cellulose fiber. Cellulose fibers are hydrophilic materials, and, therefore, when ink is provided to a cellulose fiber, the cellulose fiber can suitably take in the ink. In addition, the cellulose fiber can suitably deliver the ink that is taken temporarily to the liquid-absorbent resin 4. Hence, the liquid absorption member 10 has excellent absorption characteristics with respect to ink. Furthermore, cellulose fibers have a high affinity for the liquid-absorbent resin 4, and, therefore, a cellulose fiber can suitably support the liquid-absorbent resin 4 on a surface of the fiber. Furthermore, cellulose fibers are renewable natural materials and are inexpensive and readily available compared with various other fibers. As such, cellulose fibers are advantageous also from the standpoint of reducing the production cost, ensuring stable production, and reducing environmental impact, for example.

Note that it is sufficient that the cellulose fiber be a fibrous material containing, as a major component, cellulose included in a compound, and the compound may include hemicellulose and/or lignin in addition to cellulose.

An average length of the individual fibers is preferably 0.1 mm or greater and 7 mm or less, more preferably 0.1 mm or greater and 5 mm or less, and even more preferably 0.1 mm or greater and 3 mm or less. An average width of the individual fibers is preferably 0.5 μm or greater and 200 μm or less and more preferably 1.0 μm or greater and 100 μm or less. An average aspect ratio of the individual fibers is preferably 10 or greater and 1000 or less and more preferably 15 or greater and 500 or less. The average aspect ratio is the ratio of the average length to the average width.

When the above-mentioned ranges are satisfied, the liquid-absorbent resin 4 can be more suitably supported, ink can be more suitably held in the fiber, and the ink can be more suitably delivered to the liquid-absorbent resin 4; hence, the liquid absorption member 10 has excellent absorption characteristics with respect to ink.

1. 1. 1. 3. Liquid-Absorbent Resin

As illustrated in FIG. 3 and FIG. 4, the particles of the liquid-absorbent resin 4 are supported on the fiber substrate 3. In the illustrated example, the particles of the liquid-absorbent resin 4 are supported only on one surface 3*a* of the fiber substrate 3. Although not illustrated, some or all of the particles of the liquid-absorbent resin 4 may be supported on another surface 3*b* of the fiber substrate 3.

As illustrated in FIG. 4, the particles of the liquid-absorbent resin 4 may be partially embedded in the one surface 3*a* of the fiber substrate 3. That is, the particles of the liquid-absorbent resin 4 may be partially enclosed in the fiber substrate 3. With this configuration, the ability of the fiber substrate 3 to support the liquid-absorbent resin 4 is increased. Hence, the liquid-absorbent resin 4 is prevented from falling off the fiber substrate 3. As a result, the liquid absorption member 10, which is formed of an assembly of the small pieces 2, exhibits excellent absorption characteristics with respect to ink over a long period of time. In addition, uneven distribution of the liquid-absorbent resin 4 in the case 20 is prevented.

Note that the particles of the liquid-absorbent resin 4 may not be partially embedded in the surface 3*a* of the fiber substrate 3. The particles of the liquid-absorbent resin 4 may be merely applied to the fiber substrate 3 and thus may merely adhere to the fiber substrate 3.

The liquid-absorbent resin 4 is a super absorbent polymer (SAP) having liquid absorbency properties. The term "liquid absorbency" refers to the ability to exhibit hydrophilicity and retain liquid. The liquid-absorbent resin 4 may be gelled as a result of absorption of liquid. Specifically, the liquid-absorbent resin 4 absorbs liquid present in ink, such as water and a hydrophilic organic solvent.

Examples of the liquid-absorbent resin 4 include carboxymethyl cellulose, polyacrylic acids, polyacrylamides, starch-acrylic acid graft copolymers, hydrolysates of starch-acrylonitrile graft copolymers, vinyl acetate-acrylic ester copolymers, isobutylene-maleic acid copolymers, hydrolysates of acrylonitrile copolymers or acrylamide copolymers, polyethylene oxide, polysulfonic acid compounds, polyglutamic acids, salts thereof, modified products thereof, and crosslinked products thereof.

It is preferable that the liquid-absorbent resin 4 be a resin including structural units that contain a functional group in a side chain. Examples of the functional group include acid groups, hydroxyl groups, epoxy groups, and amino groups. In particular, it is preferable that an acid group be present in the side chain of the resin, and it is more preferable that a carboxyl group be present in the side chain of the resin.

Examples of a carboxyl-group-containing unit that may be included in the side chain include units derived from a monomer such as acrylic acid, methacrylic acid, itaconic acid, maleic acid, crotonic acid, fumaric acid, sorbic acid, cinnamic acid, an anhydride of any of the foregoing acids, or a salt of any, of the foregoing acids.

When the liquid-absorbent resin 4 is a resin including structural units that contain an acid group in a side chain, a percentage of acid groups of the liquid-absorbent resin 4 that are neutralized and form a salt, relative to the total moles of acid groups in the liquid-absorbent resin 4, is preferably 30 mol % or greater and 100 mol % or less, more preferably 50 mol % or greater and 95 mol % or less, even more preferably 60 mol % or greater and 90 mol % or less, and most preferably 70 mol % or greater and 80 mol % or less. Such a liquid-absorbent resin 4 has excellent absorption characteristics with respect to ink.

Examples of the neutralized salt include alkali metal salts, such as sodium salts, potassium salts, and lithium salts, and salts of a nitrogen-containing basic compound, such as ammonia. In particular, a sodium salt is preferable. Such a liquid-absorbent resin 4 has excellent absorption characteristics with respect to ink.

In a liquid-absorbent resin 4 including structural units that contain an acid group in a side chain, electrostatic repulsion occurs between acid groups during absorption of ink, which increases the absorption rate. Thus, such a liquid-absorbent resin 4 is preferable. Furthermore, in the instance in which acid groups are neutralized, ink can be easily absorbed into the liquid-absorbent resin 4 under osmotic pressure.

The liquid-absorbent resin 4 may have a structural unit in which no acid group is present in a side chain. Examples of such a structural unit include hydrophilic structural units, hydrophobic structural units, and structural units that serve as a polymerizable crosslinking agent.

Examples of the hydrophilic structural units include structural units derived from a nonionic compound, such as acrylamide, methacrylamide, N-ethyl (meth)acrylamide, N-n-propyl (meth)acrylamide, N-isopropyl (meth)acrylamide, N,N-dimethyl (meth)acrylamide, 2-hydroxyethyl (meth)acrylate, 2-hydroxypropyl (meth)acrylate, methoxypolyethylene glycol (meth)acrylate, polyethylene glycol mono(meth)acrylate, N-vinylpyrrolidone, N-acryloylpiperidine, or N-acryloylpyrrolidine.

Examples of the hydrophobic structural units include structural units derived from a compound such as (meth) acrylonitrile, styrene, vinyl chloride, butadiene, isobutene, ethylene, propylene, stearyl (meth)acrylate, or lauryl (meth) acrylate.

Examples of the structural units that serve as a polymerizable crosslinking agent include structural units derived from a compound such as diethyleneglycol diacrylate, N,N-methylenebisacrylamide, polyethylene glycol diacrylate, polypropylene glycol diacrylate, trimethylolpropane diallyl ether, trimethylolpropane triacrylate, allyl glycidyl ether, pentaerythritol triallyl ether, pentaerythritol diacrylate monostearate, bisphenol diacrylate, isocyanurate diacrylate, tetraallyloxyethane, or a salt of diallyloxyacetic acid.

It is preferable that the liquid-absorbent resin 4 include a polyacrylic acid salt copolymer or a crosslinked polyacrylic acid polymer. Such a liquid-absorbent resin 4 exhibits improved ink absorption performance and enables a reduction in production cost, for example.

In the crosslinked polyacrylic acid polymer, a percentage of carboxyl-group-containing structural units relative to the total moles of all the structural units included in the molecular chain is preferably greater than or equal to 50 mol %, more preferably greater than or equal to 80 mol %, and even more preferably greater than or equal to 90 mol %. If the percentage of the carboxyl-group-containing structural units is too low, it may be difficult to ensure a sufficiently good ink absorption characteristic.

It is preferable that some of the carboxyl groups in the crosslinked polyacrylic acid polymer be neutralized and form a salt. In the crosslinked polyacrylic acid polymer, a percentage of neutralized carboxyl groups relative to the total moles of all the carboxyl groups is preferably 30 mol % or greater and 99 mol % or less, more preferably 50 mol % or greater and 99 mol % or less, and even more preferably 70 mol % or greater and 99 mol % or less.

The liquid-absorbent resin 4 may include a crosslinked structure formed with a crosslinking agent other than the polymerizable crosslinking agent mentioned above.

When the liquid-absorbent resin 4 is a resin containing acid groups, it is preferable that the crosslinking agent be, for example, a compound containing acid groups and functional groups that are reactive with acid groups. When the liquid-absorbent resin 4 is a resin containing acid groups and functional groups that are reactive with acid groups, it is preferable that the crosslinking agent be a compound containing, in the molecule, functional groups that are reactive with acid groups.

Examples of the crosslinking agent containing acid groups and functional groups that are reactive with acid groups include glycidyl ether compounds, such as ethylene glycol diglycidyl ether, trimethylolpropane triglycidyl ether, (poly)glycerol polyglycidyl ether, diglycerol polyglycidyl ether, and propylene glycol diglycidyl ether; polyhydric alcohols, such as (poly)glycerol, (poly)ethylene glycol, propylene glycol, 1,3-propanediol, polyoxyethylene glycol, triethylene glycol, tetraethylene glycol, diethanolamine, and triethanolamine; and polyamines and the like, such as ethylenediamine, diethylenediamine, polyethyleneimine, and hexamethylene diamine. Other preferred examples include ions of a multivalent metal, such as zinc, calcium, magnesium, or aluminum. Such ions serve as a crosslinking agent by reacting with acid groups present in the liquid-absorbent resin 4.

The particles of the liquid-absorbent resin 4 may have any shape, such as flaky, acicular, fibrous, or substantially spherical or equiaxed, but it is preferable that most of the particles have a substantially spherical or equiaxed shape. When most of the particles of the liquid-absorbent resin 4 have a substantially spherical or equiaxed shape, an ink penetration can be easily ensured. In addition, the liquid-absorbent resin 4 can be suitably supported on the fiber. Note that the phrase "substantially spherical or equiaxed shape" refers to a shape having an aspect ratio of 0.3 or greater and 1.0 or less. The aspect ratio is the ratio of a minimum length of the particle to a maximum length thereof. An average particle diameter of the particles is preferably 15 μm or greater and 800 μm or less, more preferably 15 μm or greater and 400 μm or less, and even more preferably 15 μm or greater and 50 μm or less.

Note that the average particle diameter of the particles may be, for example, a mean volume diameter MVD, which is a volume-based mean particle diameter measured with a laser diffraction particle diameter distribution analyzer. Particle diameter distribution analyzers using the laser diffraction light scattering method as the measurement principle, that is, laser diffraction particle diameter distribution analyzers, can measure particle diameter distributions based on volume.

Preferably, a relationship of $0.15 \leq L/D \leq 467$ is satisfied, more preferably, a relationship of $0.25 \leq L/D \leq 333$ is satisfied, and even more preferably, a relationship of $2 \leq L/D \leq 200$ is satisfied, where D is the average particle diameter [μm] of the liquid-absorbent resin 4, and L is the average length [μm] of the individual fibers.

In the liquid absorption member 10, a content of the liquid-absorbent resin 4 is preferably 25 mass % or greater and 300 mass % or less and more preferably 50 mass % or greater and 150 mass % or less, relative to a mass of the fiber. With such a content, a sufficient ink absorption characteristic and a sufficient ink penetration are ensured in the liquid absorption member 10.

If the content of the liquid-absorbent resin 4 is less than 25 mass % relative to the mass of the fiber, the liquid absorption characteristics may be insufficient. On the other hand, if the content of the liquid-absorbent resin 4 is greater than 300 mass % relative to the mass of the fiber, the liquid absorption member 10 may tend to swell when the liquid absorption member 10 absorbs ink, and as a result, the penetration may be reduced.

1. 1. 1. 4. Adhesive

For example, the small pieces 2 include an adhesive 5, which bonds the liquid-absorbent resin 4 to the fiber substrates 3. The adhesive 5 bonds the liquid-absorbent resin 4 to the fiber substrates 3. Accordingly, the ability of the fiber substrates 3 to support the liquid-absorbent resin 4 is enhanced, which makes it unlikely that the liquid-absorbent resin 4 will fall off the fiber substrates 3. Note that the small pieces 2 may not include the adhesive 5.

Examples of the adhesive 5 include water-soluble adhesives and organic adhesives. In particular, a water-soluble adhesive is preferable. In instances in which an aqueous ink is used, even if a water-soluble adhesive adheres to a surface of the liquid-absorbent resin 4, the water-soluble adhesive dissolves when the ink comes into contact with the water-soluble adhesive. Thus, the adhesive 5 is prevented from interfering with the absorption of ink into the liquid-absorbent resin 4.

Example of the adhesive 5 include proteins, such as casein, soy protein, and synthetic protein; various starches, such as starch and oxidized starch; polyvinyl alcohols, which include polyvinyl alcohol and modified polyvinyl alcohols, such as cationic polyvinyl alcohols and silyl-modified polyvinyl alcohols; cellulose derivatives, such as carboxymethyl cellulose and methylcellulose; aqueous polyurethane resins; and aqueous polyester resins. In particular, a polyvinyl alcohol is preferable in terms of bonding force. With a polyvinyl alcohol, the bonding force between the fiber substrates 3 and the liquid-absorbent resin 4 is sufficiently enhanced.

In the liquid absorption member 10, a content of the adhesive 5 is preferably 1.0 mass % or greater and 70 mass % or less and more preferably 2.5 mass % or greater and 50 mass % or less, relative to the mass of the fiber. If the content of the adhesive 5 is less than 1.0 mass % relative to the mass of the fiber, it is impossible to sufficiently produce an effect of the presence of the adhesive 5. On the other hand, if the content of the adhesive 5 is too high, no further significant improvement in the ability to support the liquid-absorbent resin 4 can be achieved.

Note that the liquid absorption member 10 may include one or more of the following, for example: a surfactant, a lubricant, a defoamer, a filler, an anti-blocking agent, a UV absorber, a colorant, such as a pigment or a dye, a flame-retardant agent, and a flow improver.

1. 1. 1. 5. Bonded Portion and Unbonded Portion

As illustrated in FIG. 1, the liquid absorption member 10 includes a first portion and a second portion. The first portion is a bonded portion 12, and the second portion is an unbonded portion 14.

Figure 5:
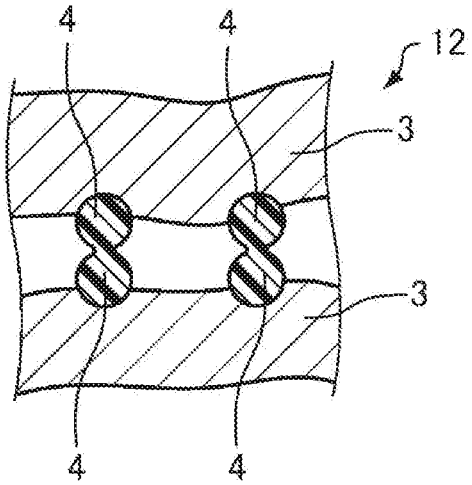
FIG. 5 is a diagram illustrating a bonded portion of the liquid absorber, according to the first embodiment.
Figure 6:
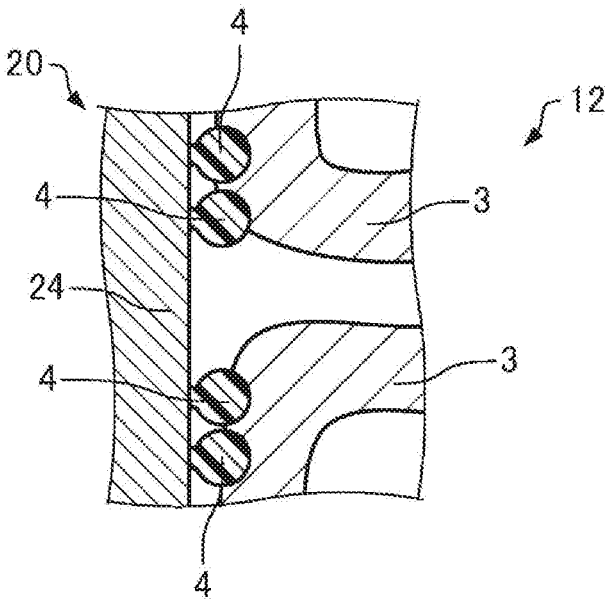
FIG. 6 is a diagram illustrating a bonded portion of the liquid absorber, according to the first embodiment.
Figure 7:
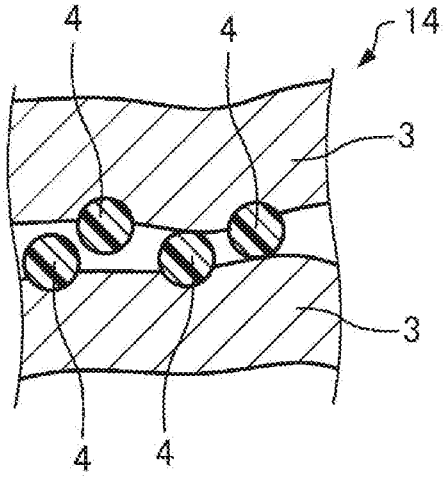
FIG. 7 is a diagram illustrating an unbonded portion of the liquid absorber, according to the first embodiment.

In the bonded portion 12, at least some of the fiber substrates 3 are bonded to one another. FIG. 5 and FIG. 6 are diagrams illustrating the bonded portion 12. FIG. 7 is a diagram illustrating the unbonded portion 14. Note that, in FIG. 5 to FIG. 7, for convenience, two fiber substrates 3 and four liquid-absorbent resin 4 particles are illustrated.

As illustrated in FIG. 5, in the bonded portion 12, at least some of the fiber substrates 3 are bonded to one another with an adhesive force of the liquid-absorbent resin 4. That is, in the bonded portion 12, at least some of the small pieces 2 are bonded to one another with the adhesive force of the liquid-absorbent resin 4. Application of water to the liquid-absorbent resin 4 causes the liquid-absorbent resin 4 to swell and exhibit tackiness. Accordingly, the liquid-absorbent resin 4 exhibits an adhesive force.

As illustrated in FIG. 6, in the bonded portion 12, at least some of the fiber substrates 3 are bonded to the case 20 with the adhesive force of the liquid-absorbent resin 4. That is, at least some of the small pieces 2 are bonded to the case 20 with the adhesive force of the liquid-absorbent resin 4. In the illustrated example, at least some of the fiber substrates 3 are bonded to a sidewall portion 24 of the case 20.

In the bonded portion 12, a content of water is, for example, 0.004 g/cm$^2$ or greater and 0.40 g/cm$^2$ or less, preferably 0.01 g/cm$^2$ or greater and 0.20 g/cm$^2$ or less, and more preferably 0.03 g/cm$^2$ or greater and 0.05 g/cm$^2$ or less, per surface area of the fiber substrates 3.

When the content of water per surface area of the fiber substrates 3 is greater than or equal to 0.004 g/cm$^2$, the fiber substrates 3 can be sufficiently bonded to one another with the adhesive force of the liquid-absorbent resin 4. Furthermore, even if the content of water per surface area of the fiber substrates 3 is increased to greater than 0.40 g/cm$^2$, the water may not easily permeate, and, therefore, a volume of the bonded portion 12 may not be increased. As a result, the bonded portion 12 has an excessive amount of water. Accordingly, the content of water is to be less than or equal to 0.40 g/cm$^2$ so as to save an amount of water.

In the liquid absorption member 10, a content of water is, for example, 5.0 mass % or greater and 20.0 mass % or less and preferably 10.0 mass % or greater and 15.0 mass % or less.

A thickness of the bonded portion 12 is, for example, 0.2 cm or greater and 1.5 cm or less and preferably 0.5 cm or greater and 1.0 cm or less. A thickness of the liquid absorption member 10 is, for example, 1.0 cm or greater and 5.0 cm or less, preferably 1.5 cm or greater and 2.0 cm or less.

In the unbonded portion 14, no water is applied, and, therefore, the liquid-absorbent resin 4 does not swell substantially and thus has little or no adhesive force, as illustrated in FIG. 7. Accordingly, at least some of the fiber substrates 3 are unbonded to one another.

1. 1. 1. 6. Layered Structure

As illustrated in FIG. 1, a plurality of the liquid absorption members 10 are provided, and the plurality of liquid absorption members 10 are stacked together. In the illustrated example, four liquid absorption members 10 are provided: a first liquid absorption member 10*a*, a second liquid absorption member 10*b*, a third liquid absorption member 10*c*, and a fourth liquid absorption member 10*d*. The first liquid absorption member 10*a*, the second liquid absorption member 10*b*, the third liquid absorption member 10*c*, and the fourth liquid absorption member 10*d* are stacked in this order in a direction from the bottom portion 22 of the case 20 toward an opening 26 of the case 20. The bonded portions 12 and the unbonded portions 14 are alternately stacked in a direction from the bottom portion 22 of the case 20 toward the opening 26 of the case 20. Note that the number of the liquid absorption members 10 is not particularly limited.

The first liquid absorption member 10*a* is in contact with the bottom portion 22 of the case 20. The first liquid absorption member 10*a* includes a first bonded portion 12*a*, which is a bonded portion 12. The first bonded portion 12*a* is disposed in a surface of the first liquid absorption member 10*a*, the surface being closer to the second liquid absorption member 10*b* than is another surface of the first liquid absorption member 10*a*.

The second liquid absorption member 10*b* is disposed adjacent to the first liquid absorption member 10*a* and is closer to the opening 26 than is the first liquid absorption member 10*a*. The second liquid absorption member 10*b* includes a second bonded portion 12*b*, which is a bonded portion 12. The second bonded portion 12*b* is disposed in a surface of the second liquid absorption member 10*b*, the surface being closer to the opening 26 of the case 20 than is another surface of the second liquid absorption member 10*b*.

The third liquid absorption member 10*c* is disposed adjacent to the second liquid absorption member 10*b* and is closer to the opening 26 than is the second liquid absorption member 10*b*. The third liquid absorption member 10*c* includes a third bonded portion 12*c*, which is a bonded portion 12. The third bonded portion 12*c* is disposed in a surface of the third liquid absorption member 10*c*, the surface being closer to the opening 26 of the case 20 than is another surface of the third liquid absorption member 10*c*.

The fourth liquid absorption member 10*d* is disposed adjacent to the third liquid absorption member 10*c* and is closer to the opening 26 than is the third liquid absorption member 10*c*. The fourth liquid absorption member 10*d* includes a fourth bonded portion 12*d*, which is a bonded portion 12. The fourth bonded portion 12*d* is disposed in a surface of the fourth liquid absorption member 10*d*, the surface being closer to the opening 26 of the case 20 than is another surface of the fourth liquid absorption member 10*d*.

1. 1. 2. Case

As illustrated in FIG. 1, the liquid absorption member 10 is stored in the case 20. The case 20 includes the bottom portion 22 and four sidewall portions 24, for example. The bottom portion 22 has a quadrilateral plan-view shape, and the sidewall portions 24 are disposed along the respective sides of the bottom portion 22, for example. The case 20 has a shape in which the opening 26 is disposed in an upper portion. Note that the plan-view shape of the bottom portion 22 is not limited to a quadrilateral shape and may be, for example, a circular shape.

It is preferable that the case 20 have a degree of shape retainability such that a volume of the case 20 does not change by 10% or greater when an internal pressure or an external force acts on the case 20. With such a degree of shape retainability, the case 20 can maintain its shape even when the liquid absorption member 10 absorbs ink and swells and thereby causes the case 20 to receive a force from the liquid absorption member 10. As a result, the installation state of the case 20 is stabilized, and consequently the liquid absorption member 10 can absorb ink in a consistent manner.

For example, a material of the case 20 is a resin material, such as a cyclic polyolefin or a polycarbonate, or a metal material, such as aluminum or stainless steel.

1. 1. 3. Cover Member

The cover member 30 is coupled to the case 20. The cover member 30 closes the opening 26 of the case 20. A shape of the cover member 30 is a plate shape, for example. An opening portion 32 is disposed in the cover member 30. A tube 506 can be coupled through the opening portion 32. The opening portion 32 is a through-hole that extends through the cover member 30 in a thickness direction thereof. When ink is to be discharged to the liquid absorber 100, the tube 506 is coupled through the opening portion 32 to discharge the ink through the tube 506.

A thickness of the cover member 30 is preferably 1 mm or greater and 20 mm or less and more preferably 8 mm or greater and 10 mm or less. Note that the cover member 30 is not limited to a plate-shaped cover member that satisfies a numerical range such as those mentioned above, and the cover member 30 may be a film-shaped cover member having a smaller thickness. In such a configuration, the thickness of the cover member 30 is preferably 10 μm or greater and less than 1 mm.

1. 1. 4. Effects

The liquid absorber 100 has the following effects, for example.

In the liquid absorber 100, the first liquid absorption member 10*a* and the second liquid absorption member 10*b* include the fiber substrates 3 and the liquid-absorbent resin 4, which is liquid-absorbent resin particles. The first liquid absorption member 10*a* includes the first bonded portion 12*a*, in which at least some of the fiber substrates 3 are bonded to one another. The first bonded portion 12*a* is disposed in a surface of the first liquid absorption member 10*a*, the surface being closer to the second liquid absorption member 10*b* than is another surface of the first liquid absorption member 10*a*. The second liquid absorption member 10*b* includes the second bonded portion 12*b*, in which at least some of the fiber substrates 3 are bonded to one another. The second bonded portion 12*b* is disposed in a surface of the second liquid absorption member 10*b*, the surface being closer to the opening 26 than is another surface of the second liquid absorption member 10*b*.

As a result, in the liquid absorber 100, uneven distribution of the fiber substrates 3 in the liquid absorption members 10*a* and 10*b*, which may be caused by, for example, vibrations during transport, can be reduced compared with a configuration in which no bonded portion is provided. Accordingly, a phenomenon in which ink is introduced to a region that is not filled with the fiber substrates 3 is prevented. Hence, good absorption characteristics are ensured. If ink is introduced to a region that is not filled with the fiber substrates 3, the ink cannot be sufficiently absorbed, and, for example, in a case in which the liquid absorber is inverted, the ink may leak out.

In addition, the liquid absorption member 10 has a reduced bulk density compared with a liquid absorption member formed by fusing together individual fibers with a fused resin, such as a thermoplastic resin, and, therefore, the liquid absorption member 10 has excellent absorption characteristics with respect to ink. Specifically, a large area of contact between ink and the fiber is ensured, and, therefore, the fiber can hold the ink temporarily. Subsequently, the ink can be delivered from the fiber to the liquid-absorbent resin 4. Accordingly, the liquid absorption member 10 has excellent absorption characteristics with respect to ink.

In addition, the liquid absorption member 10 has improved conformability to the shape of the case 20 compared with a liquid absorption member formed by fusing together individual fibers with a fused resin. Hence, the liquid absorption member 10 is highly versatile, and the production cost can be reduced.

In addition, the bonded portion 12 inhibits dust from escaping from the liquid absorption member 10.

In the liquid absorber 100, the liquid absorption member 10 includes the bonded portion 12 and the unbonded portion 14. As a result, the liquid absorber 100 can absorb a greater amount of ink than can, for example, a liquid absorber entirely formed of a bonded portion. Although the bonded portion can also absorb ink, the bonded portion may be able to absorb a smaller amount of ink than is the unbonded portion.

1. 2. Method for Producing Liquid Absorber

Figure 8:
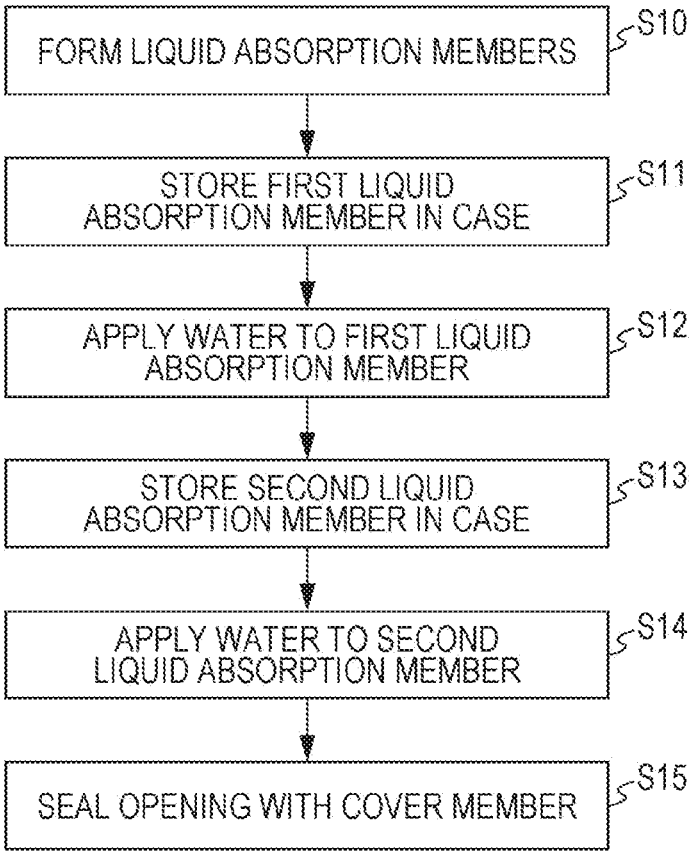
FIG. 8 is a flowchart illustrating a method for producing the liquid absorber, according to the first embodiment.

A method for producing the liquid absorber 100, according to the first embodiment, will now be described with reference to the drawings. FIG. 8 is a flowchart illustrating the method for producing the liquid absorber 100, according to the first embodiment. FIG. 9 to FIG. 13 are diagrams illustrating the method for producing the liquid absorber 100, according to the first embodiment.

First, the liquid absorption members 10 are formed (step S10). Step S10 will now be described.

Figure 9:
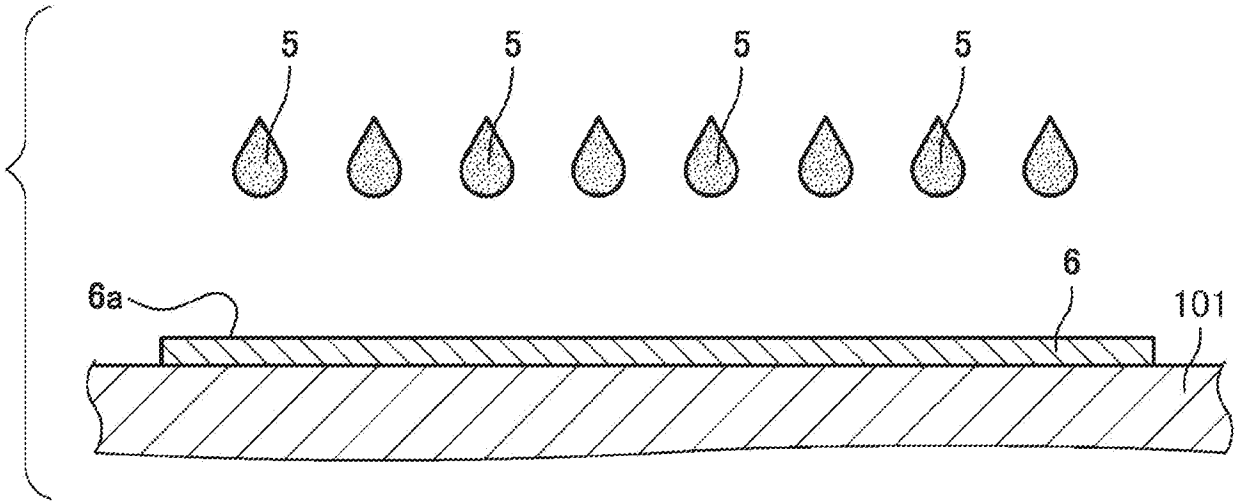
FIG. 9 is a diagram illustrating the method for producing the liquid absorber, according to the first embodiment.

As illustrated in FIG. 9, a sheet-shaped sheet member 6 is laid on a bench 101. Examples of the sheet member 6 include, but are not limited to, PPC (plain paper copier) paper.

Next, an adhesive 5, which is in a liquid form, is applied to one surface 6*a* of the sheet member 6. Examples of a method for applying the adhesive 5 include a spray method and a method in which a sponge roller is impregnated with the adhesive 5, and the sponge roller is rolled across the surface 6*a* of the sheet member 6.

Figure 10:
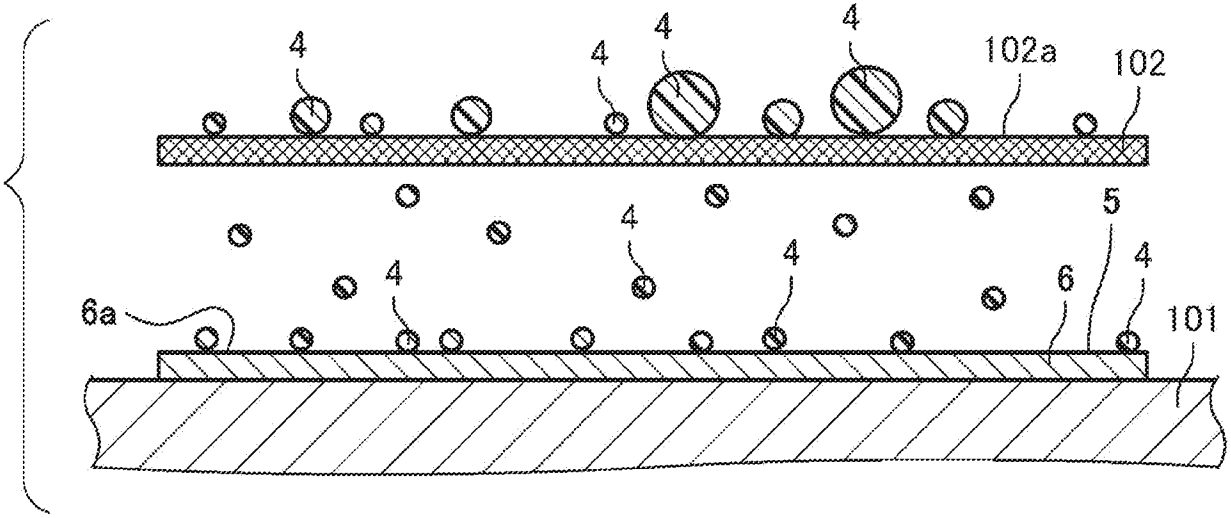
FIG. 10 is a diagram illustrating the method for producing the liquid absorber, according to the first embodiment.

As illustrated in FIG. 10, particles of the liquid-absorbent resin 4 are applied to the surface 6*a* of the sheet member 6 through a mesh member 102. The mesh member 102 has openings 102*a*. Among the particles of the liquid-absorbent resin 4, particles larger than the openings 102*a* are retained on the mesh member 102, and particles smaller than the opening 102*a* pass through the openings 102*a* and are applied to the surface 6*a* of the sheet member 6.

Thus, the use of the mesh member 102 increases the uniformity of the particle diameters of the liquid-absorbent resin 4. Hence, variations in the absorption characteristics are prevented from occurring in different locations of the sheet member 6.

A maximum width of the openings 102*a* is preferably 0.06 mm or greater and 0.15 mm or less and more preferably 0.08 mm or greater and 0.12 mm or less. With this configuration, the particle diameters of the liquid-absorbent resin 4 applied to the sheet member 6 fall within the numerical range mentioned above.

Figure 11:
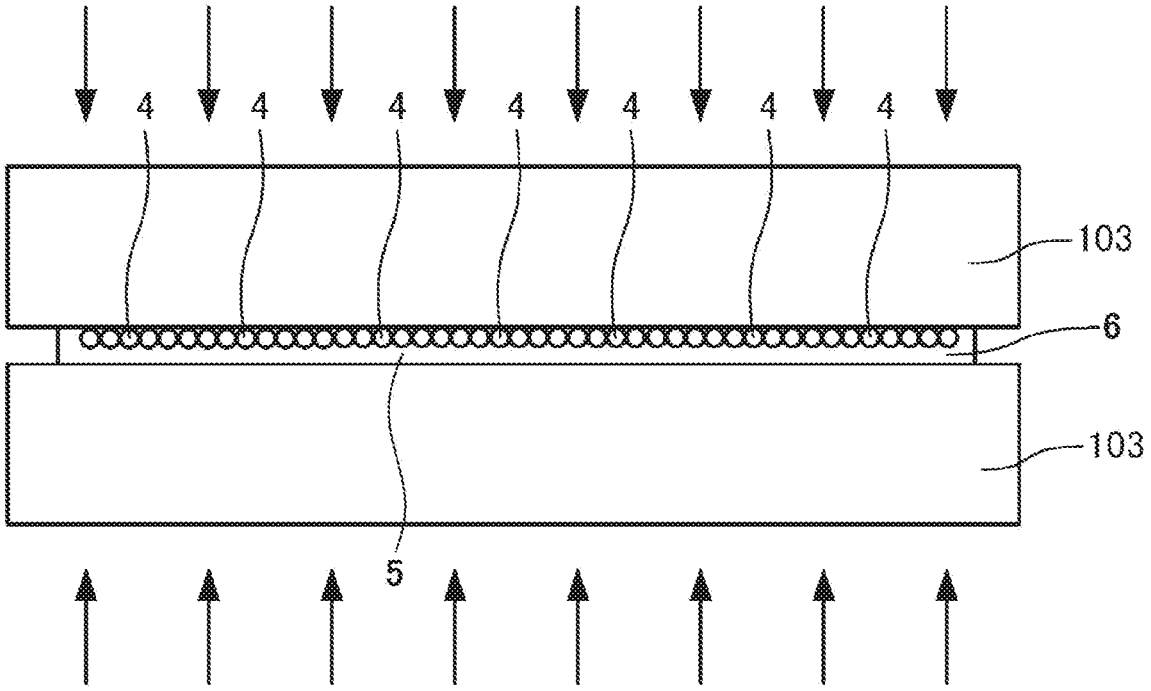
FIG. 11 is a diagram illustrating the method for producing the liquid absorber, according to the first embodiment.

As illustrated in FIG. 11, the sheet member 6, to which the particles of the liquid-absorbent resin 4 adhere, is positioned between a pair of heating blocks 103. Subsequently, the pair of heating blocks 103 is heated, and pressure is applied to the pair of heating blocks 103 in a direction in which a distance between the heating blocks 103 decreases, thereby applying pressure to the sheet member 6 in a thickness direction thereof. Accordingly, the particles of the liquid-absorbent resin 4 and the adhesive 5 are softened, and the particles of the liquid-absorbent resin 4 become embedded in the sheet member 6 as a result of the application of pressure. Subsequently, the heating and pressure application are discontinued, and, accordingly, the adhesive 5 dries, and bonding is accomplished in a state in which the particles of the liquid-absorbent resin 4 are embedded in the sheet member 6.

In this step, the force of the pressure is preferably 0.1 $kg/cm^2$ or greater and 1.0 $kg/cm^2$ or less and more preferably 0.2 $kg/cm^2$ or greater and 0.8 $kg/cm^2$ or less. In this step, the heating temperature is preferably 80° C. or higher and 160° C. or lower and more preferably 100° C. or higher and 120° C. or lower.

Next, for example, the sheet member 6 is finely cut, crushed, or ground with scissors, a cutter, a mill, a shredder, or the like or finely torn by hand, for instance.

With the steps described above, the liquid absorption members 10, which are formed of small pieces 2, can be formed. That is, the liquid absorption members 10*a*, 10*b*, 10*c*, and 10*d* can be formed.

Figure 12:
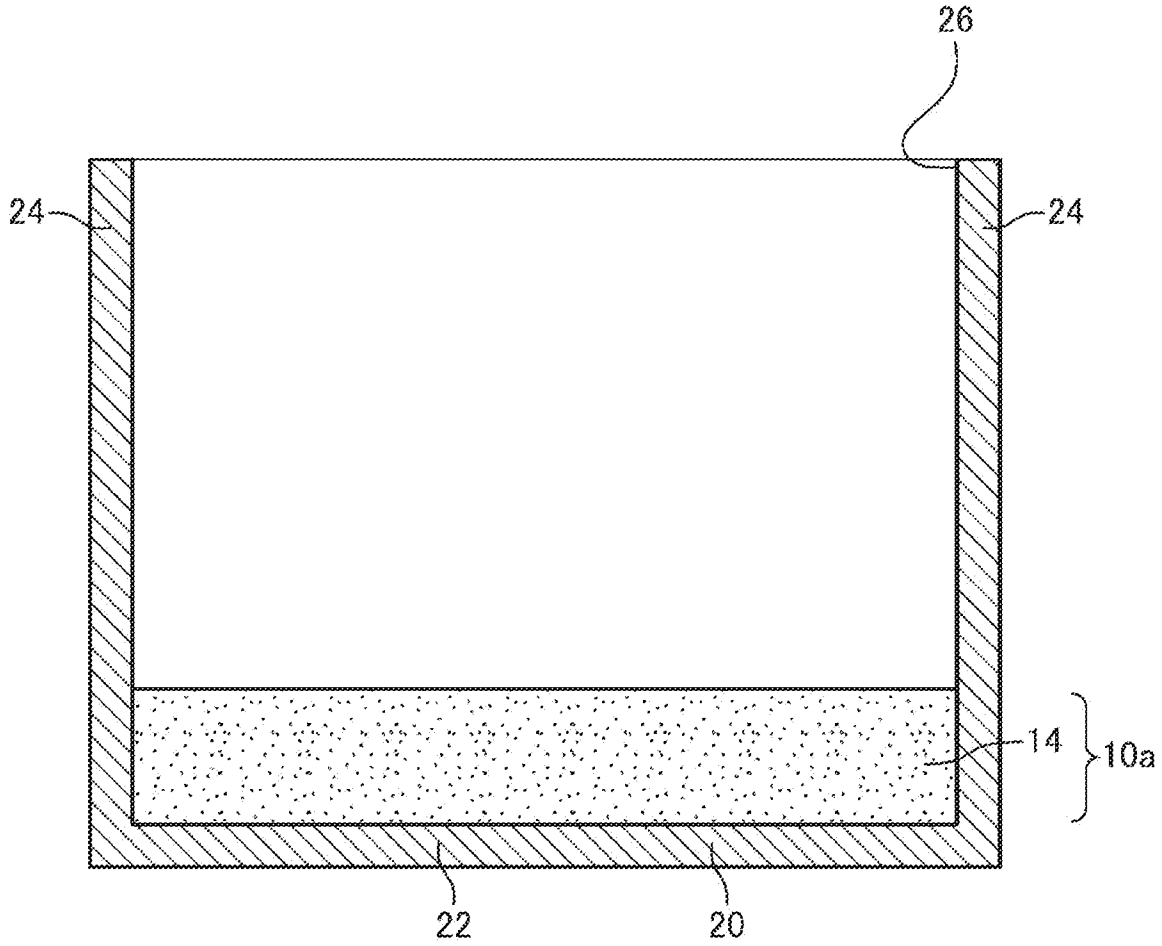
FIG. 12 is a diagram illustrating the method for producing the liquid absorber, according to the first embodiment.

Next, as illustrated in FIG. 12, the first liquid absorption member 10*a* is stored in the case 20 (step S11). For example, a desired amount of the first liquid absorption member 10*a* is weighed out and thereafter loosened up by hand, for instance, to adjust the bulk density. Then, the first liquid absorption member 10*a* is stored in the case 20.

Figure 13:
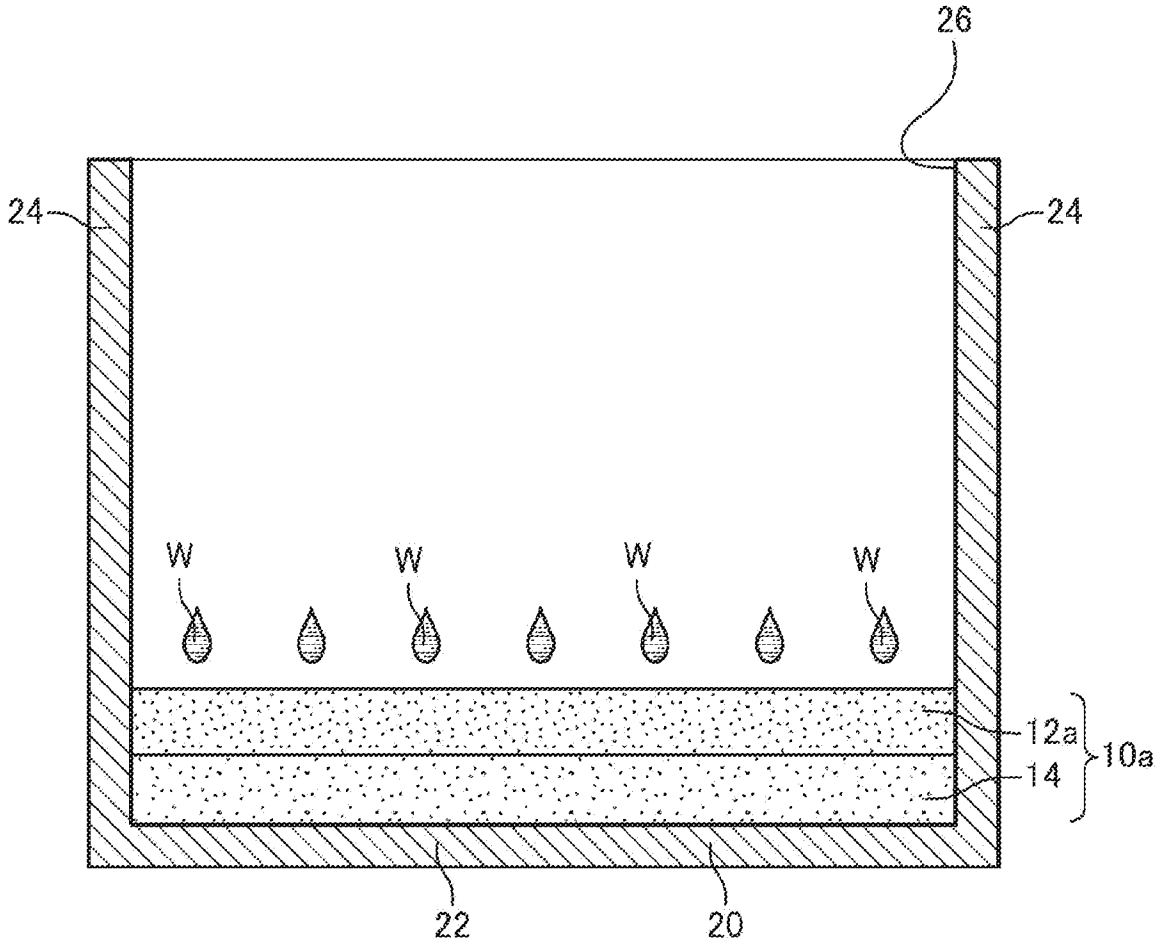
FIG. 13 is a diagram illustrating the method for producing the liquid absorber, according to the first embodiment.

Next, as illustrated in FIG. 13, water W is applied to a surface of the first liquid absorption member 10*a* from the side of the opening 26 of the case 20 (step S12). Examples of methods for applying the water include, without limitation, methods that use a spray and methods that use a dispenser. Accordingly, the liquid-absorbent resin 4 exhibits an adhesive force, and thus the first bonded portion 12*a* can be formed. The water W does not penetrate to the bottom portion 22 of the case 20. The penetration of the water W stops somewhere between the surface of the first liquid absorption member 10*a* and the bottom portion 22. Accordingly, the first liquid absorption member 10*a* includes the unbonded portion 14, to which the water W is not applied.

Next, the second liquid absorption member 10*b* is stored in the case 20; the second liquid absorption member 10*b* is positioned closer to the opening 26 than is the first liquid absorption member 10*a* (step S13). For example, a desired amount of the second liquid absorption member 10*b* is weighed out and thereafter loosened up by hand, for instance, to adjust the bulk density. Then, the second liquid absorption member 10*b* is stored in the case 20.

Next, water is applied to a surface of the second liquid absorption member 10*b* from the side of the opening 26 of the case 20 (step S14). Accordingly, the second bonded portion 12*b* can be formed.

Subsequently, step S13 and step S14 are performed on the liquid absorption members 10*c* and 10*d*. Accordingly, as illustrated in FIG. 1, the liquid absorption members 10*a*, 10*b*, 10*c*, and 10*d*, which include the bonded portions 12*a*, 12*b*, 12*c*, and 12*d*, respectively, can be stored in the case 20.

Next, as illustrated in FIG. 1, the opening 26 of the case 20 is closed with the cover member 30 (step S15). Specifically, the opening 26 of the case 20 is closed with the cover member 30 by using any of the following methods, for example: a method in which the cover member 30 is a plastic molded article and is fitted to the case 20; a method in which the cover member 30 is a film and is fused to the case 20; and a method in which the cover member 30 is a mesh member and is fused to the case 20.

With the steps described above, the liquid absorber 100 can be produced.

1. 3. Modified Example Liquid Absorber

Figure 14:
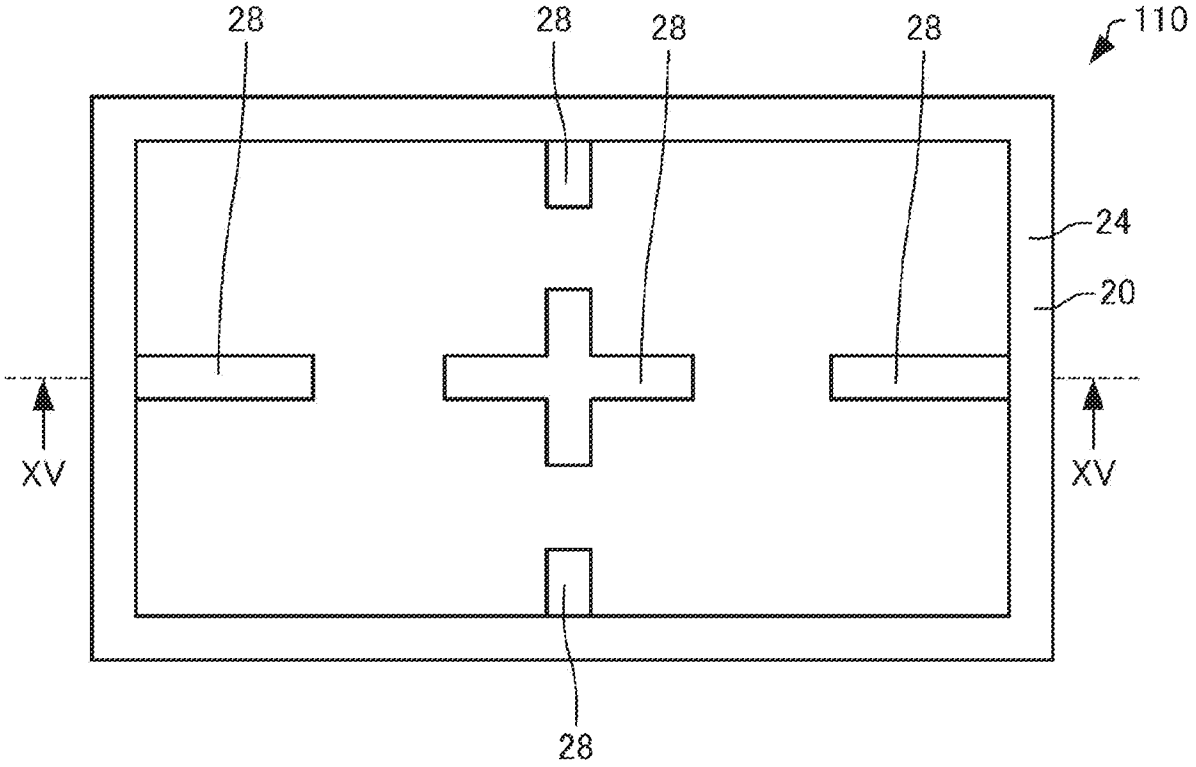
FIG. 14 is a schematic plan view of a liquid absorber according to a modified example of the first embodiment.
Figure 15:
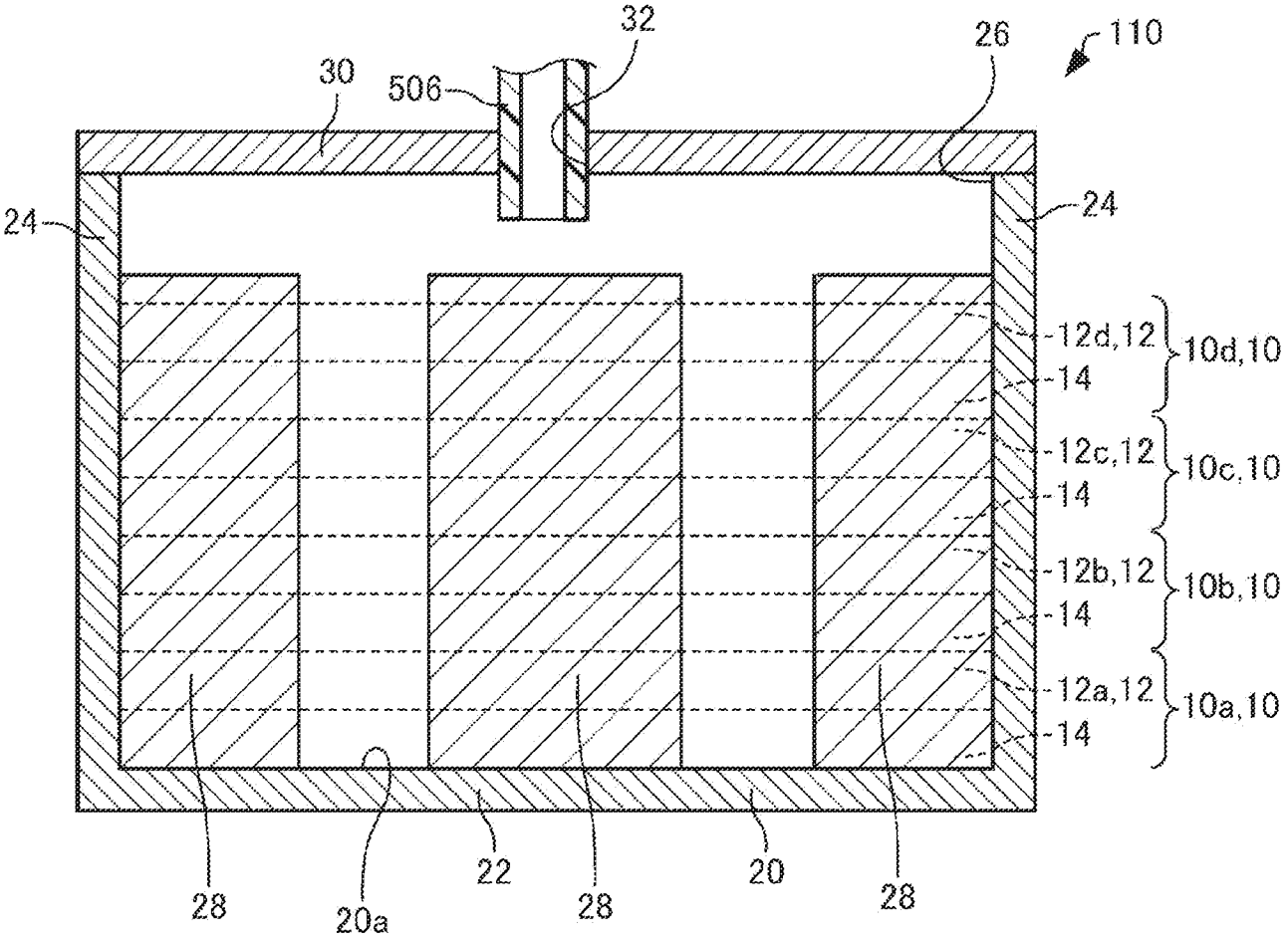
FIG. 15 is a schematic cross-sectional view of the liquid absorber according to the modified example of the first embodiment.

A liquid absorber according to a modified example of the first embodiment will now be described with reference to the drawings. FIG. 14 is a schematic plan view of a liquid absorber 110, according to a modified example of the first embodiment. FIG. 15 is a schematic cross-sectional view, taken along line XV-XV of FIG. 14, of the liquid absorber 110 according to the modified example of the first embodiment.

In the following description, regarding the liquid absorber 110 according to the modified example of the first embodiment, components having a similar function to that of a corresponding structural component of the above-described liquid absorber 100 according to the first embodiment are assigned the same reference character, and a detailed description thereof will be omitted.

The liquid absorber 110 is different from the above-described liquid absorber 100 in that the liquid absorber 110 includes a rib 28 as illustrated in FIG. 14 and FIG. 15. Note that, in FIG. 14, the liquid absorption member 10, the cover member 30, and the tube 506 are omitted for convenience. Furthermore, in FIG. 15, the rib 28 is illustrated in phantom, and the liquid absorption members 10 are indicated by the dashed lines.

The rib 28 is disposed on an inner surface 20*a* of the case 20. In the illustrated example, the rib 28 has a plate shape and is coupled to the bottom portion 22 of the case 20 and to the sidewall portions 24 of the case 20. The rib 28 protrudes from the inner surface 20*a*. In the bonded portion 12 of the liquid absorption member 10, at least some of the fiber substrates 3 are bonded to the rib 28 with an adhesive force of the liquid-absorbent resin 4. That is, at least some of the small pieces 2 are bonded to the rib 28 with the adhesive force of the liquid-absorbent resin 4. As a result, uneven distribution of the fiber substrates 3 in the liquid absorption member 10 that may be caused by, for example, vibrations during transport can be further reduced.

For example, a height of the rib 28 is 80% or greater and 90% or less of a height of the sidewall portions 24. When the height of the rib 28 is greater than or equal to 80% of the height of the sidewall portions 24, an area of contact between the liquid absorption member 10 and the rib 28 is increased. Furthermore, when the height of the rib 28 is less than or equal to 90% of the height of the sidewall portions 24, ink from the tube 506 can be uniformly supplied to the liquid absorption member 10. If the height of the rib 28 is greater than 90% of the height of the sidewall portions, ink may not be uniformly supplied to the liquid absorption member because the rib 28 may act as an obstruction.

Figure 16:
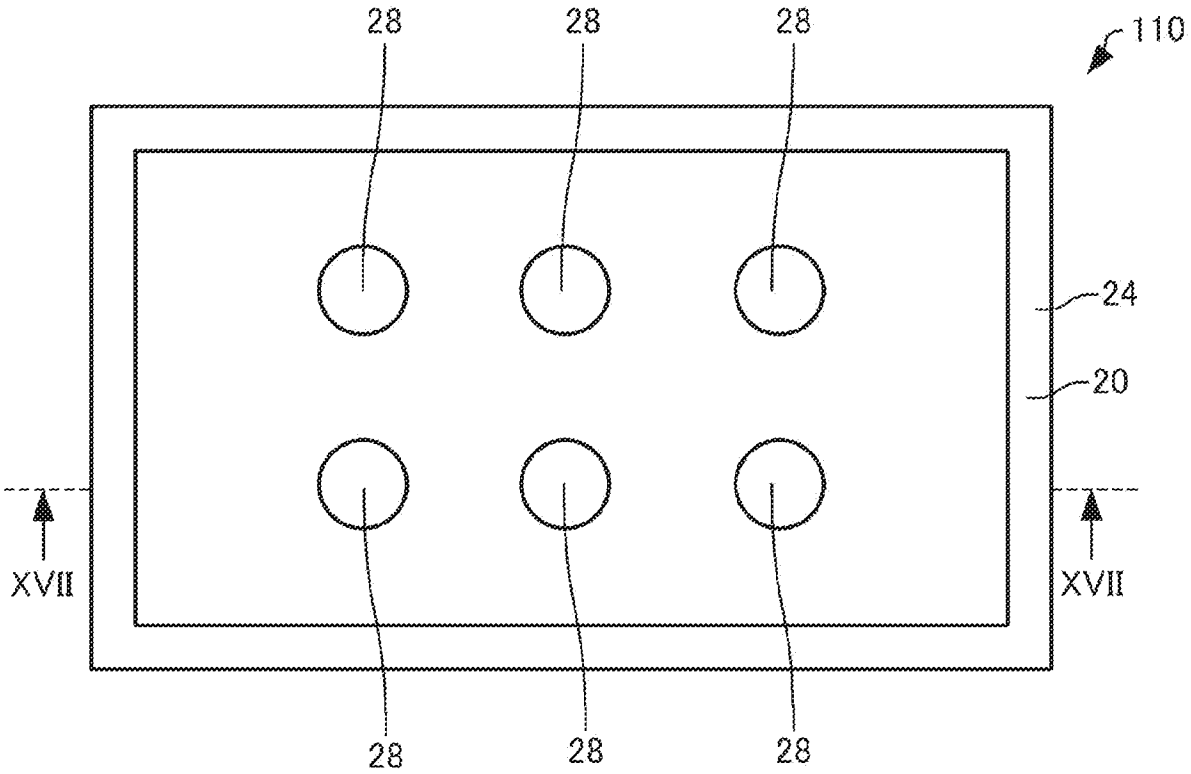
FIG. 16 is a schematic plan view of a liquid absorber according to a modified example of the first embodiment.
Figure 17:
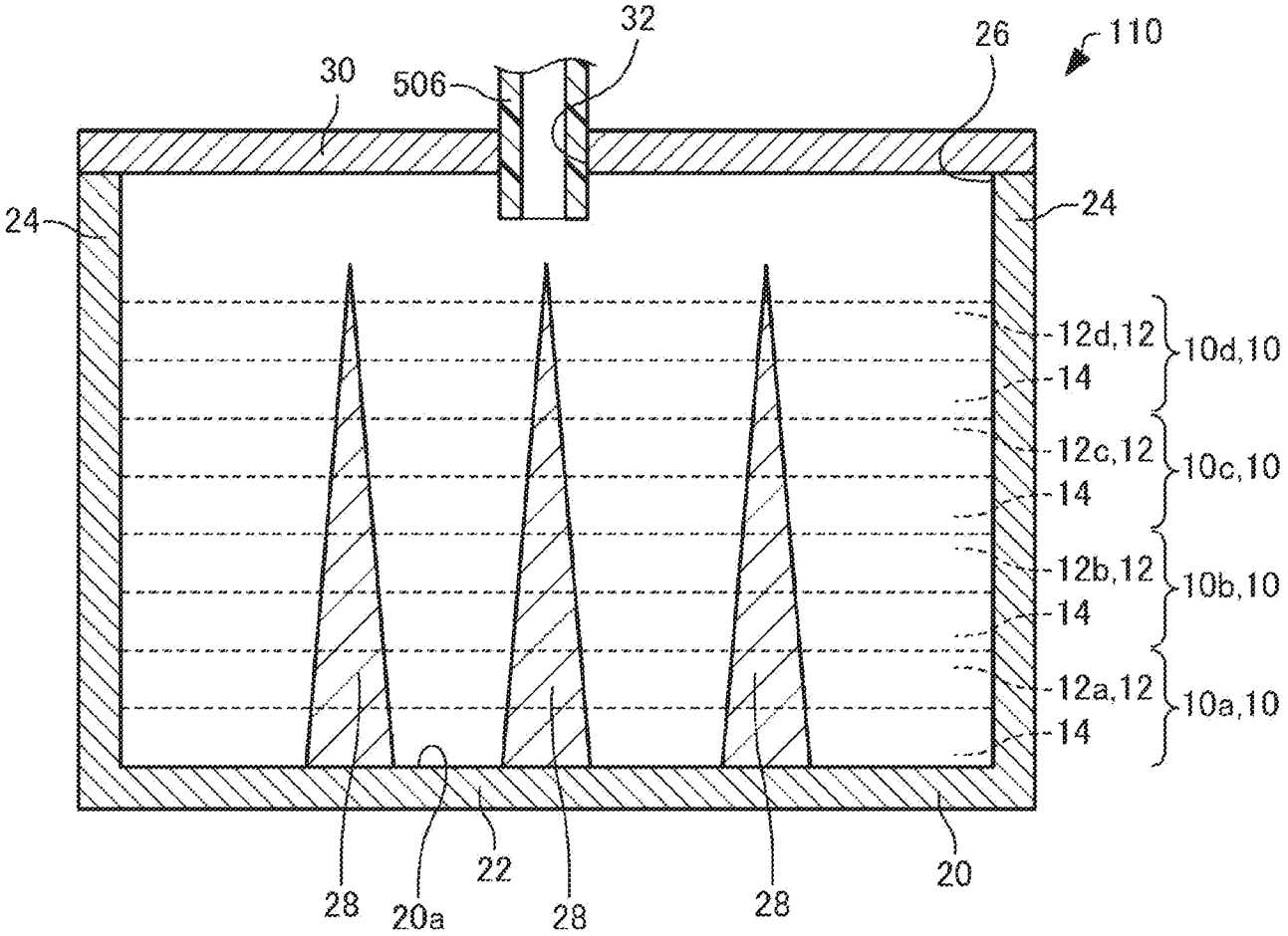
FIG. 17 is a schematic cross-sectional view of the liquid absorber according to the modified example of the first embodiment.

Note that a shape of the rib 28 is not particularly limited and, for example, may be a conical shape as illustrated in FIG. 16 and FIG. 17. When the rib 28 has a conical shape, even in a configuration in which the rib 28 is located directly below the tube 506, accumulation of ink from the tube 506 on a top surface of the rib 28 is more likely to be prevented than in a configuration in which, for example, the rib 28 has a cylindrical shape. Note that FIG. 16 is a plan view illustrating the rib 28. FIG. 17 is a cross-sectional view taken along line XVII-XVII of FIG. 16, illustrating the rib 28.

2. Second Embodiment

2. 1. Liquid Absorber

Figure 18:
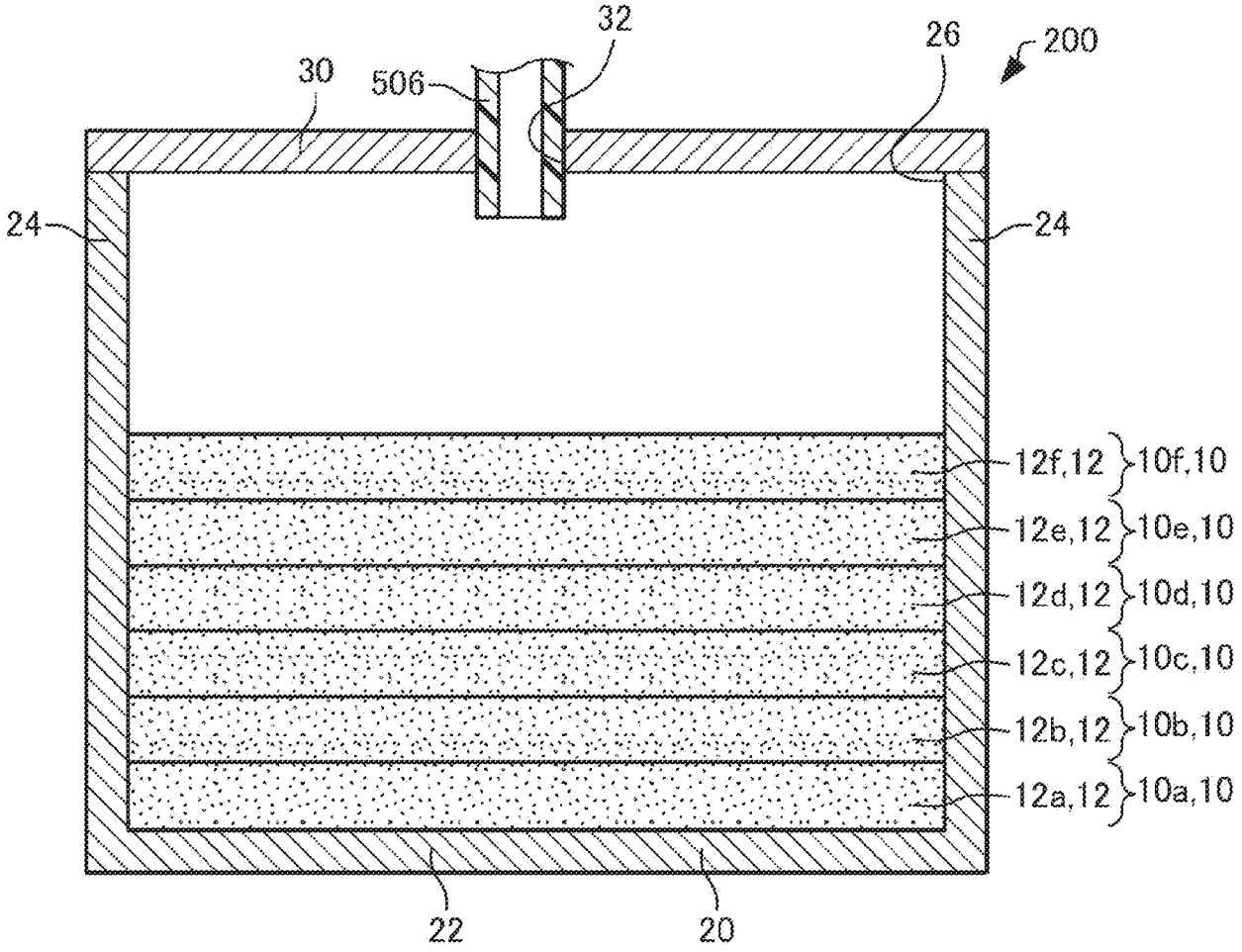
FIG. 18 is a schematic diagram of a liquid absorber according to a second embodiment.

A liquid absorber according to a second embodiment will now be described with reference to the drawings. FIG. 18 is a schematic diagram of a liquid absorber 200, according to the second embodiment.

In the following description, regarding the liquid absorber 200 according to the second embodiment, components having a similar function to that of a corresponding structural component of the above-described liquid absorber 100 according to the first embodiment are assigned the same reference character, and a detailed description thereof will be omitted.

In the liquid absorber 100 described above, the liquid absorption member 10 includes the unbonded portion 14, as illustrated in FIG. 1.

In contrast, in the liquid absorber 200, the liquid absorption member 10 includes no unbonded portion 14, as illustrated in FIG. 18. The liquid absorption member 10 is formed of bonded portions 12.

In the illustrated example, the liquid absorber 200 includes a first liquid absorption member 10*a*, which is formed of a first bonded portion 12*a*; a second liquid absorption member 10*b*, which is formed of a second bonded portion 12*b*; a third liquid absorption member 10*c*, which is formed of a third bonded portion 12*c*; a fourth liquid absorption member 10*d*, which is formed of a fourth bonded portion 12*d*; a fifth liquid absorption member 10*e*, which is formed of a fifth bonded portion 12*e*; and a sixth liquid absorption member 10*f*, which is formed of a sixth bonded portion 12*f*.

In the first liquid absorption member 10*a*, at least some of the fiber substrates 3 are bonded not only to a sidewall portion 24 of the case 20 but also to the bottom portion 22 of the case 20 with the adhesive force of the liquid-absorbent resin 4. Consequently, in the liquid absorber 200, uneven distribution of the fiber substrates 3 in the first liquid absorption member 10*a* that may be caused by, for example, vibrations during transport can be further reduced.

2. 2. Method for Producing Liquid Absorber

Figure 19:
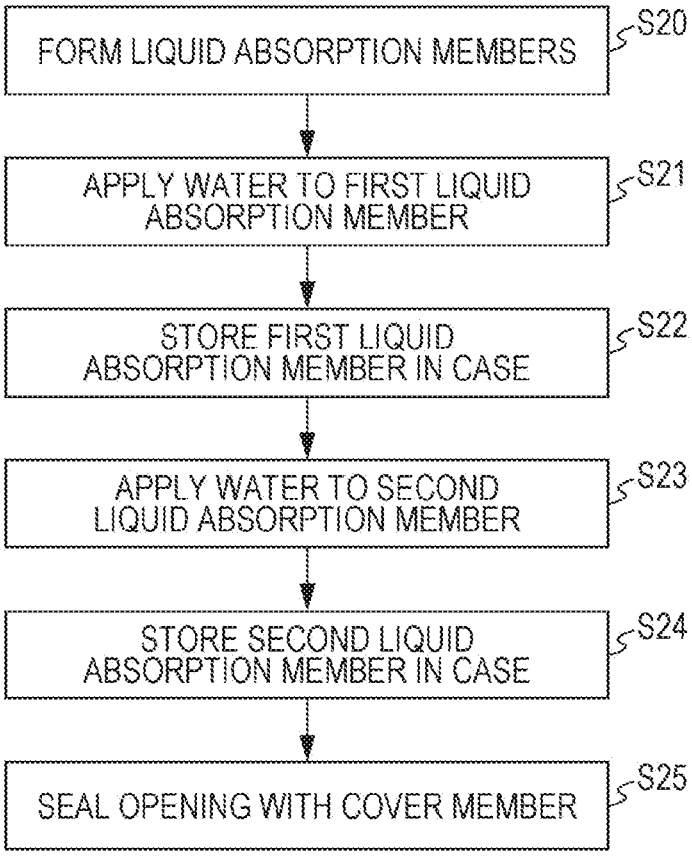
FIG. 19 is a flowchart illustrating a method for producing the liquid absorber, according to the second embodiment.

A method for producing the liquid absorber 200, according to the second embodiment, will now be described with reference to the drawings. FIG. 19 is a flowchart illustrating the method for producing the liquid absorber 200, according to the second embodiment.

First, the liquid absorption members 10 are formed (step S20). Step S20 is, for example, a step similar to step S10, described above.

Next, water is applied to the first liquid absorption member 10*a* (step S21). In this step, water is applied to the first liquid absorption member 10*a* so that the first liquid absorption member 10*a* can be formed of the first bonded portion 12*a*.

Next, the first liquid absorption member 10*a*, to which the water has been applied, is stored in the case 20 (step S22). For example, the first liquid absorption member 10*a* is stored in the case 20 while, for instance, the first liquid absorption member 10*a* is loosened up by hand.

Next, water is applied to the second liquid absorption member 10*b* (step S23). In this step, water is applied to the second liquid absorption member 10*b* so that the second liquid absorption member 10*b* can be formed of the second bonded portion 12*b*.

Next, the second liquid absorption member 10*b*, to which the water has been applied, is stored in the case 20 (step S24). For example, the second liquid absorption member 10*b* is stored in the case 20 while, for instance, the second liquid absorption member 10*b* is loosened up by hand.

Subsequently, step S23 and step S24 are performed on the liquid absorption members 10*c*, 10*d*, 10*e*, and 10*f*. Accordingly, as illustrated in FIG. 18, the liquid absorption members 10*a*, 10*b*, 10*c*, 10*d*, 10*e*, and 10*f* can be stored in the case 20.

Next, as illustrated in FIG. 18, the opening 26 of the case 20 is closed with the cover member 30 (step S15).

With the steps described above, the liquid absorber 200 can be produced.

Figure 20:
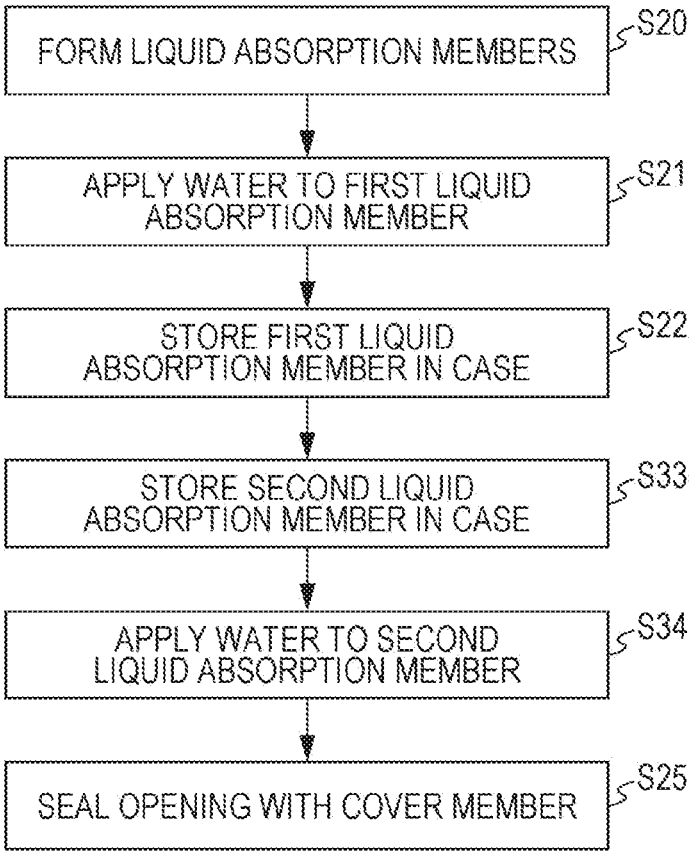
FIG. 20 is a flowchart illustrating a method for producing the liquid absorber, according to the second embodiment.

Note that, as illustrated in FIG. 20, after step S22, a second liquid absorption member 10*b* to which water has not been applied may be stored in the case 20 (step S33). Next, water may be applied to a surface of the second liquid absorption member 10*b*, which has been stored in the case 20 (step S34). For example, the second liquid absorption member 10*b* may be configured to have a thickness of 0.2 cm or greater and 1.5 cm or less, and with such a configuration, the water can be applied to the entire second liquid absorption member 10*b* in step S34. Subsequently, step S23 and step S24 may be repeated to produce the liquid absorber 200.

Furthermore, prior to step S21, water may be applied to the inner surface 20*a* of the case 20. In this instance, at least some of the fiber substrates 3 can be more reliably bonded to the inner surface 20*a* with the adhesive force of the liquid-absorbent resin 4. This step may be performed prior to step S11 of the method for producing the above-described liquid absorber 100, according to the first embodiment.

3. Third Embodiment

3. 1. Liquid Absorber

Figure 21:
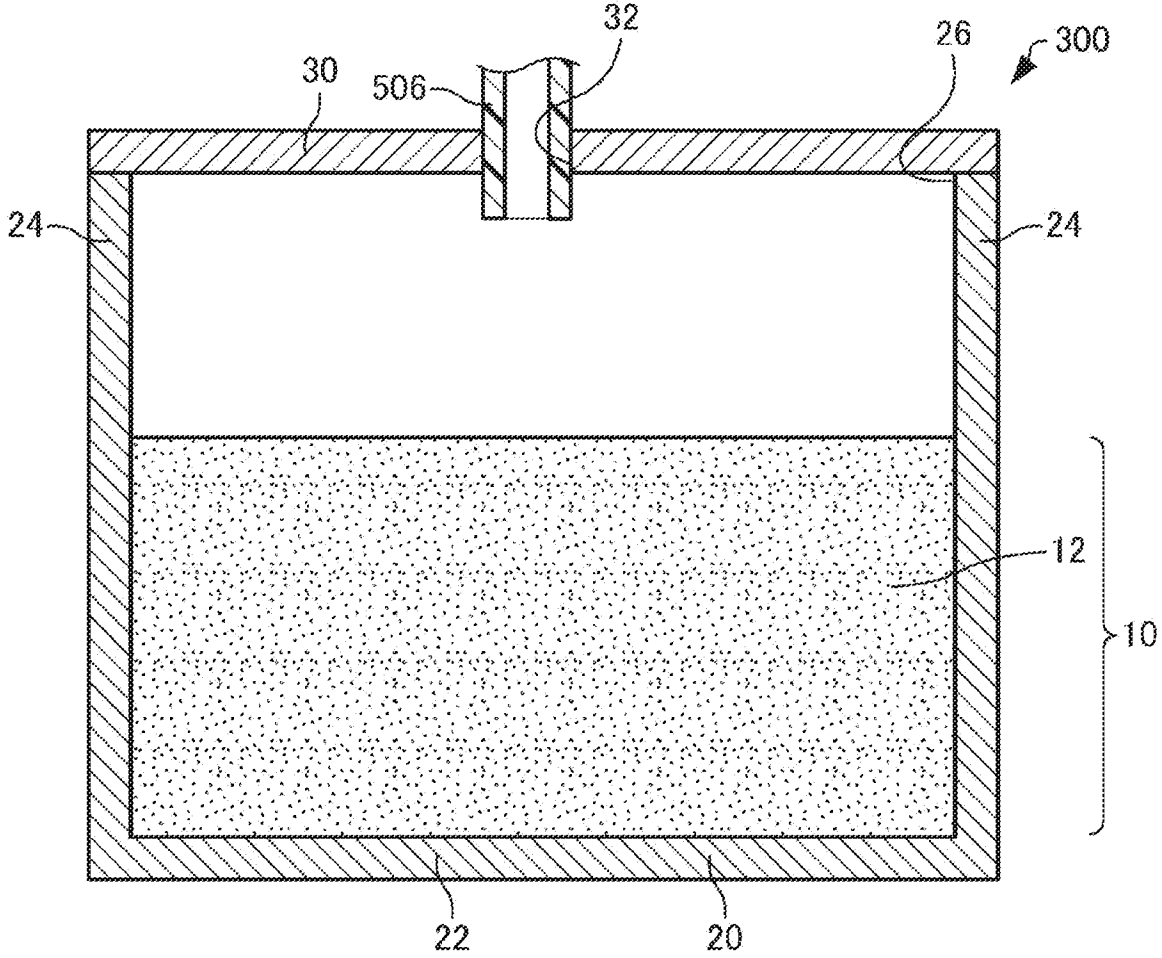
FIG. 21 is a schematic diagram of a liquid absorber according to a third embodiment.

A liquid absorber according to a third embodiment will now be described with reference to the drawings. FIG. 21 is a schematic diagram of a liquid absorber 300, according to the third embodiment.

In the following description, regarding the liquid absorber 300 according to the third embodiment, components having a similar function to that of a corresponding structural component of the above-described liquid absorber 200 according to the second embodiment are assigned the same reference character, and a detailed description thereof will be omitted.

The liquid absorber 200 described above includes a plurality of the liquid absorption members 10, as illustrated in FIG. 18.

In contrast, as illustrated in FIG. 21, the liquid absorber 300 includes one liquid absorption member 10, not a plurality of the liquid absorption members 10.

3. 2. Method for Producing Liquid Absorber

A method for producing the liquid absorber 300, according to the third embodiment, will now be described.

For the liquid absorber 300, the liquid absorption member 10 is formed as in the method for producing the liquid absorber 200, according to the second embodiment, and thereafter, when the liquid absorption member 10 is being stored in the case 20, water is applied to the liquid absorption member 10. Specifically, when the small pieces 2 of the liquid absorption member 10 are being dropped to the bottom portion 22 of the case 20, water is applied to the small pieces 2. The small pieces 2, to which the water has been applied, are stored in the case 20. Accordingly, the liquid absorption member 10, with any desired thickness, can be stored in the case 20. Subsequently, the opening 26 of the case 20 is closed with the cover member 30.

With the steps described above, the liquid absorber 300 can be produced.

Note that in the methods for producing the above-described liquid absorber 100 or 200, at least one of the liquid absorption members 10 may be formed in the same manner as that of the method for producing the liquid absorber 300, that is, by dropping the small pieces 2 while applying water to the small pieces 2.

4. Fourth Embodiment

4. 1. Liquid Absorber

Figure 22:
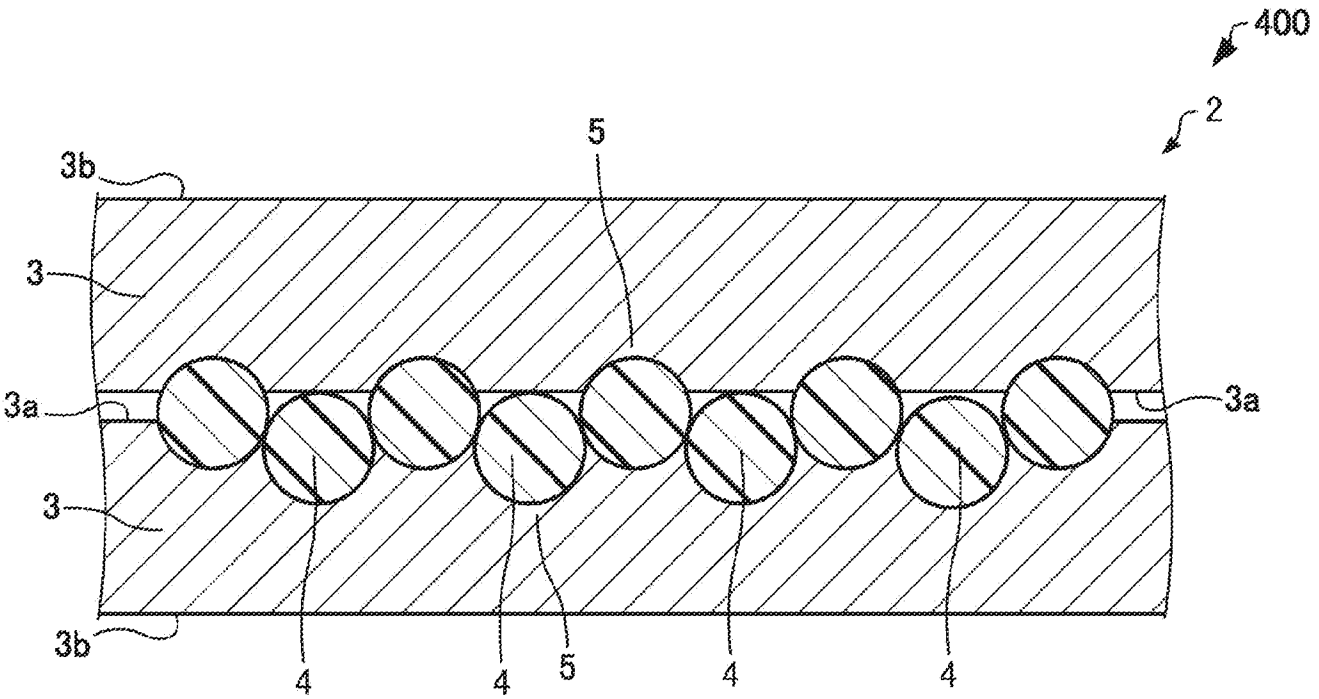
FIG. 22 is a schematic cross-sectional view of a small piece included in a liquid absorber, according to a fourth embodiment.

A liquid absorber according to a fourth embodiment will now be described with reference to the drawings. FIG. 22 is a schematic cross-sectional view of a small piece 2, which is included in a liquid absorber 400, according to the fourth embodiment.

In the following description, regarding the liquid absorber 400 according to the fourth embodiment, components having a similar function to that of a corresponding structural component of the above-described liquid absorber 100 according to the first embodiment are assigned the same reference character, and a detailed description thereof will be omitted.

As illustrated in FIG. 22, the liquid absorber 400 is different from the above-described liquid absorber 100 in that the liquid-absorbent resin 4 is held between a pair of the fiber substrates 3.

In the liquid absorber 400, the liquid-absorbent resin 4 is held between a pair of the fiber substrates 3, and, therefore, the liquid-absorbent resin 4 is unlikely to fall off the fiber substrates 3 compared with a configuration in which the liquid-absorbent resin 4 is not held between fiber substrates 3. Accordingly, excellent absorption characteristics with respect to ink are exhibited over a long period of time. In addition, uneven distribution of the liquid-absorbent resin 4 in the case 20 is prevented, and, therefore, variations in the ink absorption characteristics are prevented from occurring.

4. 2. Method for Producing Liquid Absorber

Figure 23:
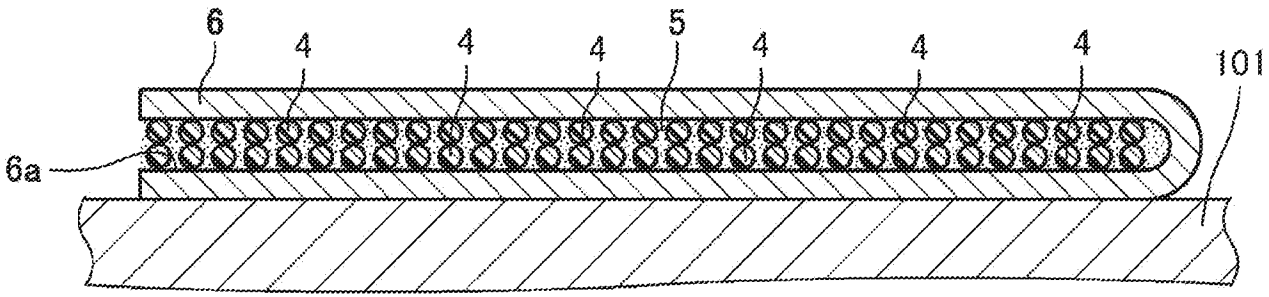
FIG. 23 is a diagram illustrating a method for producing the liquid absorber, according to the fourth embodiment.
Figure 24:
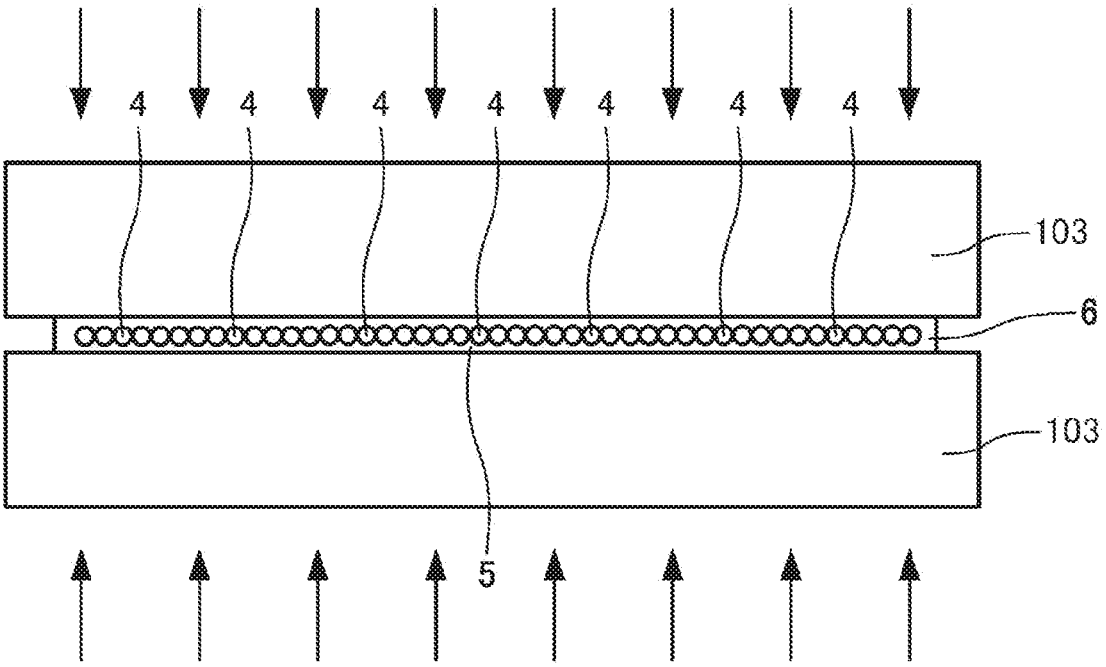
FIG. 24 is a diagram illustrating the method for producing the liquid absorber, according to the fourth embodiment.

A method for producing the liquid absorber 400, according to the fourth embodiment, will now be described with reference to the drawings. FIG. 23 and FIG. 24 are diagrams illustrating the method for producing the liquid absorber 400, according to the fourth embodiment.

As illustrated in FIG. 23, particles of the liquid-absorbent resin 4 are applied to the sheet member 6 laid on the bench 101, and thereafter, the sheet member 6 is folded in a manner such that the surface 6*a*, which includes the applied particles of the liquid-absorbent resin 4, is located on the inner side.

As illustrated in FIG. 24, the folded sheet member 6 is positioned between the pair of heating blocks 103. Subsequently, the pair of heating blocks 103 is heated, and pressure is applied to the pair of heating blocks 103 in a direction in which a distance between the heating blocks 103 decreases, thereby applying pressure to the sheet member 6 in a thickness direction thereof. Accordingly, the particles of the liquid-absorbent resin 4 and the adhesive 5 are softened by the heat, and the particles of the liquid-absorbent resin 4 become embedded in the sheet member 6 as a result of the application of pressure. Furthermore, the particles of the liquid-absorbent resin 4 that come into contact with one another as a result of the folding are softened and joined together.

Subsequently, the heating and pressure application are discontinued, and, accordingly, the adhesive 5 dries, and bonding is accomplished in a state in which the particles of the liquid-absorbent resin 4 are embedded in the sheet member 6, and further, the folded halves of the sheet member 6, which overlap each other, are joined together with the particles of the liquid-absorbent resin 4 and the adhesive 5.

Next, the sheet member 6 is cut in a shredder or the like. The subsequent steps are basically the same as those of the method for producing the liquid absorber 100 described above.

In the method for producing the liquid absorber 400, the configuration including multilayers of the sheet member 6 is realized by the simple process, that is, by applying the liquid-absorbent resin 4 to a single sheet member 6 and folding the sheet member 6. That is, there is no need for the operation of applying the liquid-absorbent resin 4 to two sheet members 6 separately. Accordingly, the production process is simplified.

In addition, in the sheet member 6, the surface free of the liquid-absorbent resin 4 comes into contact with the heating blocks 103. Accordingly, adhering of the liquid-absorbent resin 4 to the heating blocks 103 is prevented. Hence, there is no need for a step of cleaning the heating blocks 103.

Note that in the example described above, at least some of the fiber substrates 3 are bonded to one another, and at least some of the fiber substrates 3 are bonded to the case 20, with the adhesive force of the liquid-absorbent resin 4, which is swollen with water. In another example, at least some of the fiber substrates 3 may be bonded to one another, and at least some of the fiber substrates 3 may be bonded to the case 20, with a bonding force of a water-soluble adhesive. In another example, at least some of the fiber substrates 3 may be bonded to the rib 28 with the bonding force of a water-soluble adhesive. In this instance, in the methods for producing any of the liquid absorbers, a water-soluble adhesive solution is to be applied instead of water.

Example of the water-soluble adhesive include polyvinyl alcohols, which include polyvinyl alcohol and modified polyvinyl alcohols, such as cationic polyvinyl alcohols and silyl-modified polyvinyl alcohols; cellulose derivatives, such as carboxymethyl cellulose and methylcellulose; aqueous polyurethane resins; and aqueous polyester resins.

In another example, at least some of the fiber substrates 3 may be bonded to one another with both the adhesive force of the liquid-absorbent resin 4 and the bonding force of a water-soluble adhesive. Similarly, at least some of the fiber substrates 3 may be bonded to the case 20 with both the adhesive force of the liquid-absorbent resin 4 and the bonding force of a water-soluble adhesive. Similarly, at least some of the fiber substrates 3 may be bonded to the rib 28 with both the adhesive force of the liquid-absorbent resin 4 and the bonding force of a water-soluble adhesive. In this instance, in the methods for producing any of the liquid absorbers, a water-soluble adhesive solution is to be applied instead of water.

5. Fifth Embodiment

Figure 25:
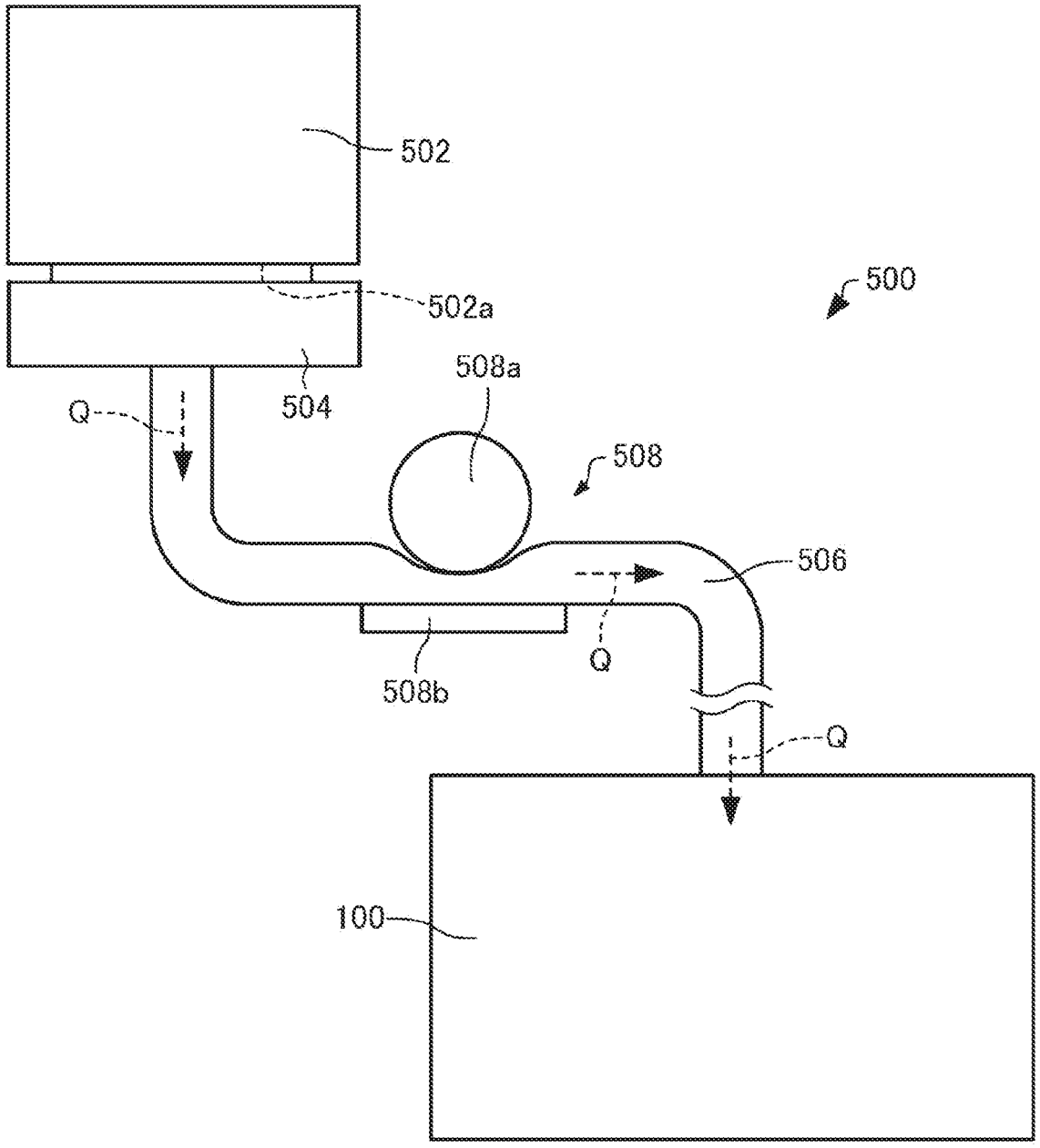
FIG. 25 is a schematic diagram of a liquid ejection apparatus according to a fifth embodiment.

A liquid ejection apparatus according to a fifth embodiment will now be described with reference to the drawings. FIG. 25 is a schematic diagram of a liquid ejection apparatus 500, according to the fifth embodiment.

As illustrated in FIG. 25, the liquid ejection apparatus 500 includes, for example, a liquid ejection head 502, a capping unit 504, the tube 506, a roller pump 508, and the liquid absorber 100. The liquid ejection head 502 ejects an ink Q. The capping unit 504 prevents clogging of nozzles 502*a* of the liquid ejection head 502. The tube 506 couples the capping unit 504 to the liquid absorber 100. The roller pump 508 delivers the ink Q from the capping unit 504. The liquid absorber 100 collects waste liquid of the ink Q.

The liquid ejection head 502 includes nozzles 502*a*, through which the ink Q is ejected downwardly. The liquid ejection head 502 can perform printing on a recording medium (not illustrated), such as PPC paper, by moving relative to the recording medium and ejecting the ink Q onto the recording medium.

The capping unit 504 prevents clogging of the nozzles 502*a* in a manner such that when the liquid ejection head 502 is in standby position, the roller pump 508 is actuated to cause the capping unit 504 to apply suction collectively to the nozzles 502*a*.

The tube 506 allows the ink Q, which is sucked through the capping unit 504, to pass through the tube 506 to the liquid absorber 100. The tube 506 may have flexibility, for example.

The roller pump 508 is located at a portion along the tube 506. The roller pump 508 includes a roller member 508*a* and a holder member 508*b*, which holds the portion of the tube 506 with the roller member 508*a*. Rotation of the roller member 508*a* generates a suction force in the capping unit 504 via the tube 506. Further, continuous rotation of the roller member 508*a* enables the ink Q adhering to the nozzles 502*a* to be delivered to the liquid absorber 100. The ink Q is delivered to the liquid absorber 100 and absorbed as a waste liquid.

The liquid absorber 100 is attachably and detachably mounted to the liquid ejection apparatus 500. In a state in which the liquid absorber 100 is mounted to the liquid ejection apparatus 500, the liquid absorber 100 absorbs the ink Q, which is ejected from the liquid ejection head 502. The liquid absorber 100 is a so-called waste liquid tank. When the amount of absorbed ink Q in the liquid absorber 100 has reached a limit, the liquid absorber 100 can be replaced with a new, unused liquid absorber 100.

Note that whether the amount of absorbed ink Q in the liquid absorber 100 has reached a limit may be detected by a detector (not illustrated) of the liquid ejection apparatus 500. Furthermore, when the amount of absorbed ink Q in the liquid absorber 100 has reached a limit, a notification of the fact may be made by a notification unit, which may be a built-in monitor of the liquid ejection apparatus 500 or the like.

In the present disclosure, one or more elements may be omitted, and various embodiments and/or modified examples may be combined together, as long as the features and effects described in the present application are retained.

The present disclosure is not limited to the embodiments described above, and various other modifications may be made. For example, the present disclosure includes configurations substantially identical with the configurations described in the embodiments. The substantially identical configurations are, for example, configurations in which functions, methods, and results are identical or configurations in which objects and effects are identical. Furthermore, the present disclosure includes configurations in which one or more non-essential elements of the configurations described in the embodiments are replaced with different elements. Furthermore, the present disclosure includes configurations that produce an effect identical with that of the configurations described in the embodiments or configurations that make it possible to achieve an object identical with that of the configurations. Furthermore, the present disclosure includes configurations in which one or more elements of the known art are added to any of the configurations described in the embodiments.

What is claimed is:

1. A liquid absorber comprising:

a case having an opening;

a first liquid absorption member stored in the case, the first liquid absorption member being a member that absorbs a portion of a liquid; and a second liquid absorption member stored in the case, the second liquid absorption member being a member that absorbs a portion of the liquid, the second liquid absorption member being disposed adjacent to the first liquid absorption member and being closer to the opening than is the first liquid absorption member, wherein the first liquid absorption member and the second liquid absorption member include fiber substrates and a liquid-absorbent resin, the liquid-absorbent resin being liquid-absorbent resin particles, the first liquid absorption member includes a first bonded portion in which at least some of the fiber substrates are bonded to one another, the first bonded portion being disposed in a surface of the first liquid absorption member, the surface being closer to the second liquid absorption member than is another surface of the first liquid absorption member, the second liquid absorption member includes a second bonded portion in which at least some of the fiber substrates are bonded to one another, the second bonded portion being disposed in a surface of the second liquid absorption member, the surface being closer to the opening than is another surface of the second liquid absorption member, the at least some of the fiber substrates in the first liquid absorption member are bonded to a bottom portion of the case and a sidewall portion of the case with at least one of a bonding force of a water-soluble adhesive and an adhesive force of the liquid-absorbent resin, and the at least some of the fiber substrates in the second liquid absorption member are bonded to a sidewall portion of the case with the at least one of a bonding force of a water-soluble adhesive and an adhesive force of the liquid-absorbent resin.

2. The liquid absorber according to claim 1, wherein in the first bonded portion, the at least some of the fiber substrates are bonded to one another with the at least one of a bonding force of a water-soluble adhesive and an adhesive force of the liquid-absorbent resin, and in the second bonded portion, the at least some of the fiber substrates are bonded to one another with the at least one of a bonding force of a water-soluble adhesive and an adhesive force of the liquid-absorbent resin.

3. The liquid absorber according to claim 1, wherein a rib is disposed on an inner surface of the case, the rib protruding from the inner surface, and the at least some of the fiber substrates in the first liquid absorption member and the at least some of the fiber substrates in the second liquid absorption member are bonded to the rib with the at least one of a bonding force of a water-soluble adhesive and an adhesive force of the liquid-absorbent resin.

4. The liquid absorber according to claim 3, wherein the first liquid absorption member and the second liquid absorption member are formed of small pieces, the small pieces include the fiber substrates and the liquid-absorbent resin, the liquid-absorbent resin being supported on the fiber substrates, and at least some of the small pieces are bonded to one another with at least one of a bonding force of a water-soluble adhesive and an adhesive force of the liquid-absorbent resin.

5. The liquid absorber according to claim 4, wherein the at least some of the small pieces are bonded to at least one of the case and the rib with the at least one of a bonding force of a water-soluble adhesive and an adhesive force of the liquid-absorbent resin.

6. The liquid absorber according to claim 4, wherein the liquid-absorbent resin is held between a pair of the fiber substrates.

7. A liquid ejection apparatus comprising:

a liquid ejection head; and the liquid absorber according to claim 1, the liquid absorber being an absorber that absorbs the liquid, the liquid being ejected from the liquid ejection head.

* * * * *